US006123030A

United States Patent [19]

Dohr et al.

[11] Patent Number: 6,123,030

[45] Date of Patent: Sep. 26, 2000

[54] GATE ASSEMBLY FOR A RAILROAD HOPPER CAR

[75] Inventors: Jeremy J. Dohr, Kenosha; Brian A. Senn, South Milwaukee; Robert S. Toms, Racine, all of Wis.

[73] Assignee: Miner Enterprises, Inc., Del.

[21] Appl. No.: 09/065,819

[22] Filed: Apr. 23, 1998

[51] Int. Cl.[7] ..... B61D 7/00

[52] U.S. Cl. ..... 105/282.2

[58] Field of Search ..... 105/280, 282.1, 105/282.2, 283, 282.3, 284, 308.1, 308.2; 298/24, 27, 28, 29; 222/559, 561

[56] References Cited

U.S. PATENT DOCUMENTS

| | | | |
|---|---|---|---|
| 2,640,438 | 6/1953 | Dorey | 105/282 |
| 2,738,735 | 3/1956 | Zimmer | 105/282 |
| 2,738,736 | 3/1956 | Dorey | 105/282 |
| 2,751,860 | 6/1956 | Dath | 105/282.2 |
| 3,255,714 | 6/1966 | Dorey | 105/253 |
| 3,332,363 | 7/1967 | Becker | 105/280 |
| 3,387,570 | 6/1968 | Pulcrano et al. | 105/282 |
| 3,397,654 | 8/1968 | Snyder | 105/305 |
| 3,415,204 | 12/1968 | Pase | 105/282 |
| 3,536,013 | 10/1970 | Nagy | 105/282 |
| 3,708,209 | 1/1973 | Dugge | 302/52 |
| 3,831,803 | 8/1974 | Hutchinson | 220/46 R |
| 3,843,204 | 10/1974 | Fischer | 302/52 |
| 3,893,398 | 7/1975 | Fischer | 105/308 R |
| 3,933,100 | 1/1976 | Dugge | 105/282 P |
| 4,149,470 | 4/1979 | Sambucetti | 105/282 P |
| 4,253,400 | 3/1981 | Fischer et al. | 105/282.2 |
| 4,301,741 | 11/1981 | Chierici | 105/282 P |
| 4,360,295 | 11/1982 | Anderson | 406/75 |
| 4,568,224 | 2/1986 | Dugge et al. | 406/90 |
| 4,785,966 | 11/1988 | Waitke | 220/345 |
| 5,613,446 | 3/1997 | DiLuigi et al. | 105/282.2 |
| 5,697,535 | 12/1997 | Coleman | 222/561 |

*Primary Examiner*—Mark T. Le
*Attorney, Agent, or Firm*—John W. Harbst

[57] ABSTRACT

A gate assembly for a hopper car having an enclosure for holding and transporting particulate matter and a plurality of openings along a bottom of the car through which particulate matter is discharged. The gate assembly is designed to allow for either pneumatic discharge of the particulate matter as a result of pressure differentials applied to the outlet on the hopper car or gravitational discharge of the particulate matter through a covered discharge plenum depending from a discharge opening defined by the frame of the gate assembly. The gate assembly further includes seal structure and a gate mounted on the frame for elevational movements between sealed and unsealed conditions and for sliding movements between open and closed positions. The gate assembly further includes a mechanism for arranging the frame, the gate and the seal structure in sealed relationship relative to each other such that a gage pressure of up to 15 psig. can be established in the enclosure of the car during unloading of the particulate matter. To reduce the effort required to condition the car for unloading and transport, the mechanism for sealing the gate relative to the frame of the gate assembly furthermore acts to arrange the cover used to seal the discharge opening in timed relationship with the sealing/unsealing of the gate assembly. The gate assembly further includes seal structure biased against an underside of the gate to seal closed the opening through which the gate horizontally reciprocates between the open and closed positions. Furthermore, edge seals are spring biased against opposed edges of the gate to enhance the sealing relationship of the gate to the frame of the gate assembly.

117 Claims, 11 Drawing Sheets

GATE ASSEMBLY FOR A RAILROAD HOPPER CAR

FIELD OF THE INVENTION

The present invention relates generally to railroad hopper cars and, more specifically, to a gate assembly for controlling discharge of particulate matter from an enclosure of the hopper car either pneumatically or gravitationally.

BACKGROUND OF THE INVENTION

Basic railroad hopper car structures involve an enclosure for holding particulate matter. Such railroad cars are typically provided with a plurality of openings arranged along a bottom thereof. A conventional hopper car is also provided with a series of slope sheets or slanted walls funneling downwardly toward each opening to facilitate the discharge of the particulate matter from the car.

Various methods and devices are known in the art for closing the openings disposed along the bottom of the hopper car. Basically, such closure devices are divisible into two categories. Some hopper cars utilize a sliding gate or valve type device for selectively opening and closing the openings at the bottom of the discharge gate. Alternatively, some hopper cars are provided with pneumatically enabled discharge openings which rely on a pressure differential system for exhausting particulate matter from the enclosure of the hopper car.

A conventional slide gate device includes a frame which is bolted or otherwise secured to the hopper car. The frame defines a discharge opening arranged in operative combination with an opening at the bottom of the slanting walls on the hopper car. A gate is arranged on the frame for sliding movement between open and closed positions relative to a respective discharge opening. When open, the sliding gate permits the contents of the hopper car enclosure to pass gravitationally through the discharge opening defined by the frame of the gate assembly. When closed, the sliding gate shuts off the material or matter flow through the gate.

A conventional pneumatic discharge system for hopper cars involves connecting a discharge assembly including a housing beneath each opening in the bottom of the hopper car. A pneumatic discharge conduit extends from the housing longitudinally of the car and is adapted to be connected to a suction hose or the like for conducting the particulate matter exhausted from the enclosure of the hopper car to any suitable discharge location. An air inlet conduit, connected to a suitable air pressure supply source, introduces pressurized air into the enclosure of the hopper car thereby increasing the pressure therewithin. Preferably, the air is introduced into the enclosure of the hopper car as through permeable sheets typically arranged along the slanted walls of the hopper car thereby promoting movement of the particulate matter toward the openings along the bottom of the hopper car and the particulate matter is withdrawn from the enclosure as a result of the pressure differential.

The transportation and unloading of finely divided materials, and particularly food stuffs, such as sugar, flour and the like within and from the enclosure of a hopper car adds further problems to the design of railroad hopper car discharge gate assemblies. When the lading to be transported involves food stuffs, the FDA has certain rules and regulations which must be met in order for the hopper car to qualify for transporting such food stuffs. Of course, a paramount concern involves designing the hopper car such that no foreign matter, accumulation of moisture, or insect infiltration is permitted to contact and possibly contaminate the food stuffs even while they are being discharged or unloaded from the railway hopper car.

In those hopper cars which transport food stuffs and utilize a sliding gate for controlling the discharge of matter from the enclosure of the hopper car, such gate designs are conventionally equipped with a circumferential housing or skirt depending from the gate in surrounding relation to the discharge opening in the frame of the gate assembly to define a discharge plenum. Typically, an air sled or other portable unload apparatus is clamped to the underside of the skirt during a discharge operation thereby permitting the food stuffs in the enclosure of the hopper car to be discharged directly and protectively into the sled and, thus, conveyed away from the hopper car. To inhibit debris such as dirt, dust, insects, moisture, clay and smoke from contaminating the underside of the gate and the interior of the discharge plenum during transport of the hopper car, such gate designs typically include a sanitary plate or cover which slides between open and closed positions in a horizontal plane generally parallel to the gate to close the discharge plenum during transport of the hopper car.

Sliding gate closures have proven adequate over the years. There are problems, however, inherent with these designs. The frame of the gate assembly on which the gate slides is typically provided with supports or ledges on which the gate moves. Often times there is a buildup of material fines on such ledges following discharge of the particulate matter from the hopper car. When the gate is returned to its closed position, the material fines are deposited on an upper surface of the gate and get in the way of complete sealing of discharge opening on the gate assembly. As will be appreciated, these fines become packed and caught between the surface of the gate and the perimeter of the opening and the gasket or seals that may surround the opening in conventional closure assemblies, thus, preventing complete resealing of the bottom discharge opening of the hopper car.

Another problem has also been identified with sliding gates when the material to be discharged involves fine granular food stuffs or material. As will be appreciated, to enable the sliding gate to operate between positions, an operating gap or opening must be provided between the frame of the gate assembly and the gate. Such gap or opening is typically provided between the skirt on the frame of the opening and the gate. It is through this opening or gap that contaminants, moisture, smoke, dust, clay and insects can enter the discharge plenum, thus, contaminating the food stuffs upon discharge from the hopper car. Moreover, during a discharge procedure, the fine materials from the enclosure of the hopper car leak through even the smallest of openings and are lost thereby causing adverse economic considerations while further complicating the discharge of materials from the hopper car.

Arranging seals or gaskets about the discharge opening in an attempt to close or seal such openings has often resulted in the seal or gasket being pulled from the gate assembly either by the materials exiting from the hopper car or from the sliding movement of the gate toward an open position. Thus, the seals or gaskets often further complicate the discharge of material from the hopper car. Moreover, having fine particulate matter on the top or upper surface of the gate when slid closed further exacerbates the ability of the seals to form an adequate closure relative to the gate of the gate assembly.

As mentioned above, pneumatic unloading devices rely on the creation of a pressure differential to effect unloading of the hopper car enclosure. While this basic concept of unloading eliminates some of the above-mentioned problems of slide gate systems, the pneumatic unloading system increases the complexities of the design of the hopper car as well as the costs and efficiencies as comparted to slide gate unloading systems. By way of example, unloading speed is an important consideration with regard to economical operation and, thus, is an important consideration to some railroads and hopper car builders. Gravity unloading of the various openings along the bottom of the hopper car can be effected substantially simultaneously. Whereas, suction tube or pneumatic unloading through the various pneumatically enabled openings on some hopper cars is limited with respect to number of unloaders available for use with each car. Additionally, pneumatic unloading of a hopper car involves designing the hopper car such that it must hold a gage pressure within the enclosure of up to about 15 psig. when the car is being unloaded. Heretofore known gaskets or seals are simply not capable of holding a pressure of up to about 15 psi. within the enclosure of a hopper car during unloading of the particulate matter from the car.

Thus, there is a need and a desire for a hopper car having an enclosure capable of carrying fine particulate food stuffs therewithin but which is capable of discharging the particulate matter in a manner overcoming the problems identified above.

SUMMARY OF THE INVENTION

In view of the above, and in accordance with the present invention, there is provided gate assembly adapted to be arranged in combination with a hopper car having an enclosure in which particulate matter is held and transported. As is conventional, the hopper car defines a plurality of openings through which the particulate matter is discharged. A series of interconnected walls funnel downwardly toward each opening in the hopper car to facilitate the discharge of the particulate matter. The hopper car furthermore defines an outlet arranged adjacent each opening. According to the present invention, a gate assembly is arranged in combination with each opening on the hopper car. A primary object of the present invention is to provide a gate assembly specifically designed to allow for either pneumatic or gravitational discharge of particulate matter from the enclosure of the hopper car.

The gate assembly of the present invention includes a rigid frame defining a discharge opening arranged in cooperative relationship and registry with the opening on the car when the gate assembly is mounted to the hopper car. To inhibit debris, moisture and insect infiltration, the gate assembly of the present invention is provided with seal structure carried on the frame in surrounding relationship relative to the discharge opening defined by the frame of the gate assembly. Moreover, an elongated gate is movably carried on said frame. The gate is moved between positions by a drive mechanism. In one position, the gate, the seal structure and the frame of the gate assembly are arranged in sealed relation relative to each other to allow an increased pressure to be established in the enclosure of said hopper car thereby promoting discharge of the particulate matter from the enclosure through the outlet defined by the hopper car under the influence of a pressure differential. When the gate is alternatively moved to a second position, particulate matter in the enclosure of the hopper car is permitted to gravitationally pass through the discharge opening defined by the frame of the gate assembly.

In a preferred form of the invention, the frame of the gate assembly defines a ledgeless opening through which particulate matter is permitted to pass after the gate is opened. In this preferred form of the invention, the frame furthermore includes a depending wall structure or skirt in surrounding relation relative to and depending from the ledgeless opening to define a discharge plenum through which particulate matter passes. The frame of the gate assembly preferably includes a pair of laterally spaced extensions projecting outwardly from the frame for supporting the gate when moved to an open position, thus, promoting the provision of a ledgeless discharge opening design on the frame of the gate assembly.

To facilitate connection of a discharge sled thereto, the lower end of the depending walled structure or skirt on the frame of the gate assembly is configured with flanges which operate in combination with an inlet to the unloading sled thereby enhancing transference of particulate matter from the enclosure of the hopper car to the unloading sled. In this form of the invention, the gate is slidably mounted on the frame for movement between the outlet on the hopper car and the plenum chamber defined by the frame of the gate assembly.

The drive mechanism for moving the gate between positions can take a myriad of different forms without detracting or departing from the spirit and scope of the present invention. In a preferred form of the invention, the drive mechanism includes a rack and pinion assembly for moving the gate between open and closed positions. In a most preferred form of the invention, the drive mechanism includes an operating shaft assembly mounted on the frame of the gate assembly for rotation about a fixed axis. The operating shaft assembly includes an elongated shaft rotatably mounted on the frame of the gate assembly with operating handles at opposite ends thereof, at least one pinion mounted along the length of and for rotation with the elongated shaft, and a rack secured to an underside of the gate and engagable with the pinion such that upon rotation of said elongated shaft the gate is moved relative to the frame between open and closed positions.

The seal structure of the present invention includes an elastomeric seal arranged in surrounding relation relative to the discharge opening defined by the frame of the gate assembly. In a preferred form of the invention, the seal is mounted to an interior of the discharge opening defined by the gate assembly. In a preferred form of the invention, a plurality of fasteners accurately mount the seal to the frame of the gate assembly. The seal structure is preferably configured to seal the fasteners along the length thereof passing through the frame of the gate assembly.

The seal preferably includes upper and lower sections with a rigid material member disposed therebetween, thus, adding strength and rigidity to the seal structure. Moreover, the upper section of the seal is configured with a beveled or slanting surface to promote movement of particulate matter therepast. The lower section of the seal preferably has a hollow configuration to enhance compressibility thereof. In a most preferred form of the invention, the lower section of the seal is furthermore configured with projections or ridges extending longitudinally of the seal.

The seal structure of the present invention preferably further includes another elastomeric seal mounted to the exterior of the frame of the gate assembly and across the upper surface of that portion of the gate disposed and slidable beneath an end wall on the frame of the gate assembly. This exterior or outer seal is intended to inhibit moisture and insect infiltration along the top or upper surface of the gate while conjointly acting with the inner seal in maintaining a gage pressure of up to 15 psig. within the interior of the enclosure of the hopper car. In a most preferred form of the invention, this outer or exterior seal of the seal structure includes a resilient elastomeric member with a rigid metal mount arranged in combination therewith for securing the outer seal to the frame of the gate assembly while adding significant strength and rigidity thereto. Moreover, the outer seal preferably includes a hollow lower section to enhance the compressibility of the seal when the gate is pressed against the seal structure.

One of the salient features of the present invention involves recognizing a mechanism or design capable of establishing a sufficient force between the gate, the seal structure and frame of the gate assembly to permit a gage pressure of about 15 psig. to be maintained in the enclosure of the hopper car. Accordingly, one aspect of the present invention relates to a mechanism provided for urging the gate, the seal structure and the frame of the gate assembly into a sealing relationship with each other when the gate is in the closed position and with sufficient force such that the enclosure of the hopper car can be pressurized up to about 15 psig. The ability to pressurize the enclosure of the hopper car up to about 15 psig. advantageously permits the discharge of particulate matter through the pneumatically enabled outlet on the hopper car under the influence of a pressure differential.

In the illustrated form of the invention, the mechanism for accomplishing the goal of maintaining a gage pressure of up to about 15 psig. in the enclosure of the hopper car during unloading of the particulate matter includes structure for elevating the gate into engagement with the seal structure carried on the frame of the gate assembly. In a most preferred form, the mechanism for urging the gate into engagement with the seal structure preferably includes a series of cam assemblies or rotatable actuators arranged beneath the gate and carried on the frame of the gate assembly.

The rotatable actuators or cam assemblies are preferably disposed toward opposite ends of the gate and extend in a direction generally normal to the direction in which the gate moves between open and closed positions. Each cam assembly or actuator is rotatable between an engaged position and a disengaged position. In the engaged position, the cam assembly engages the underside of the gate thereby pressing the gate against the seal structure with sufficient force to permit the increased pressure to be created and maintained in the enclosure of the hopper car thereby promoting pressure differential unloading of the hopper car. In the disengaged position, the gate is lowered to a position wherein the upper surface of the gate is no longer pressed against the seal structure thereby allowing the gate to be moved to an open position without incurring or resulting in damage to the seal structure.

In a most preferred form of the invention, each cam assembly includes a shaft journalled by and sealed relative to the frame of the gate assembly for rotation about a fixed axis. The cam assembly defines a surface arranged along the length of the shaft in eccentric or offset relation to the fixed axis. An operating handle is preferably secured to each end of the shaft and is disposed to promote operational access to the cam assembly from the exterior and either side of the frame of the gate assembly.

The cam assemblies preferably operate as self-cleaning mechanisms. That is, after the gate is opened and the particulate matter is discharged from the enclosure, rotation of the cam assemblies is required to effect closure of the gate of the gate assembly. Rotation of the cam assemblies to urge the gate to an elevated position and into engagement with the seal structure likewise imparts a cleaning effect on the cam assemblies.

According to one form of the invention, the cam assemblies or actuators are configured to releasably lock the gate in a closed position. That is, each cam assembly used to urge the gate into an elevated position is preferably configured as an overcenter mechanism. As such, when the cam assembly is in an engaged position it has been moved overcenter. The resilient force of the seal structure acts to press downwardly on the cam assemblies thereby preventing them from freely rotating or turning to a released or disengaged position. Thus, the overcenter design of each cam assembly promotes locking engagement of the gate relative to the frame.

According to another aspect of the present invention, a cover or sanitary plate is carried on the frame of the gate assembly and is arranged in operative combination with the depending wall structure or skirt on the frame for inhibiting contamination of the plenum chamber. The cover is alternatively movable between open and closed positions. In the closed position, the cover or sanitary plate inhibits contamination of the discharge plenum. Latch structure is preferably provided on the cover or sanitary plate for releasably holding the cover in an open position. In its open position, the cover allows particulate matter in the enclosure of the hopper car to pass from the gate assembly through the discharge opening after the gate is moved to an open position and through the discharge plenum. In a most preferred form of the invention, the cover or sanitary plate is mounted to the frame of the gate assembly for movement about a generally horizontal axis extending generally parallel with the gate.

According to another aspect of the present invention, the cover is latched in a closed position in timed relation with the gate being pressed into sealing engagement with the seal structure. In a preferred form of the invention, the same mechanism used to seal closed the discharge opening in the frame cooperates with the latch structure on the cover or sanitary plate to seal closed the sanitary plate to the frame of the gate assembly. In the illustrated form of the invention, the latch structure operates in combination with at least one of the rotatable cam assemblies or actuators. When operated, the latch structure moves the cover or sanitary plate into sealing relationship with the walled structure on the frame of the gate assembly substantially simultaneously with sealing of the gate closed thereby sealing the discharge plenum against contamination from dust, debris, dirt, smoke and clay as the railroad hopper car is transported between locations.

According to still another aspect of the present invention there is provided a lower seal extending across an underside of the gate. The purpose of the lower seal extending across an underside of the gate is to seal closed that opening in the discharge plenum permitting the gate to slidably move between open and closed positions. During transport of the railroad car, this lower seal inhibits moisture, dirt, dust, smoke, clay and other debris from passing along the underside of the gate and into the discharge plenum. When the gate is opened to discharge particulate matter through the discharge plenum, the lower seal remains engaged with the underside of the gate thereby inhibiting particulate matter from escaping from the discharge plenum.

The lower seal for engaging the underside of the gate is disposed between the rack and pinion assembly and a free end of the gate so as to not interfere with operation of the drive mechanism for moving the gate. In a preferred form of the invention, the lower seal is mounted in an open top cavity or channel defined by the frame of the gate assembly and is biased against the underside of the gate to accommodate vertical shifting movements of the gate without any detrimental or deteriorating sealing effects. In a most preferred form of the invention, the lower seal is configured as a continuous seal bar extending between opposed sides of the gate. To enhance its sealing features and yet provide extended life during use, the lower seal is preferably fabricated from ultra-high molecular weight polyethylene. Alternatively, and for simplicity purposes, the lower seal could be configured as a wiper seal.

Still another aspect of the present invention relates to providing edge seals in operable combination with opposed sides of the gate. During transport of the railroad car, the edge seals inhibit moisture, dirt, dust, smoke, clay and other debris from passing along between the sides of the gate and the frame into the discharge plenum. When the gate is opened to discharge particulate matter through the discharge plenum, the edge seals engage the opposed sides of the gate thereby inhibiting particulate matter from escaping from the discharge plenum during the unloading operation.

In the illustrated form of the invention, the edge seals are carried by the frame of the gate assembly and are resiliently biased against opposed sides of the gate. The edge seals are elongated in a generally vertical direction to accommodate vertical shifting movements of the gate relative to the frame of the gate assembly. In a preferred form of the invention, the edge seals are fabricated from ultra-high molecular weight polyethylene.

As will be appreciated from an understanding of the present invention, there is provided a gate assembly with seal structure for allowing a hopper car to discharge the particulate matter held within the enclosure of the car either pneumatically or gravitationally. The seal structure of the gate assembly of the present invention protects the enclosure from contaminants while maintaining a gage pressure of about 15 psig. within the enclosure of the hopper car during unloading. The ability to hold up to about 15 psig. advantageously allows a pressure differential type of unloading to be effected for the particulate matter in the enclosure of the car.

Alternatively, the gate may be unsealed from the frame and moved to an open position to allow the particulate matter to be discharged gravitationally from the enclosure into either an unload apparatus or directly into a reservoir. Requiring the gate to be lowered before the gate is moved to an open position advantageously prolongs the useful life of the seals and inhibits them from being torn or ripped from the gate assembly. To facilitate discharge of the fine material matter from the enclosure, the discharge opening in the frame of the gate assembly has a ledgeless design. Moreover, the discharge plenum defined by the frame of the gate assembly of the present invention is provided with a flared skirt configuration thereby allowing a sled to be readily and effectively arranged in operable combination therewith. In this alternative method of discharge operation, the frame, gate and seal structure are resealed relative to each other with the gate in an open position.

During car transport, the discharge plenum is sealed by a sanitary plate or cover extending across the bottom thereof. When gravitational unloading is to be effected, the sanitary plate or cover is pivoted about a generally horizontal axis into a position whereat it is removed from the discharge plenum thereby allowing unencumbered access to the bottom of the gate assembly. With the present invention, sealing of the upper surface of the gate against the seal structure as through the mechanism on the gate coincidentally allows the cover or sanitary plate to be brought into sealing engagement with the discharge plenum thereby economizing on the time required to place the car in condition for travel following discharge of the material from the enclosure thereof.

The cam assemblies for actuating the seal structure, as by vertically elevating the gate into pressed engagement therewith, are disposed beneath the gate. When particulate matter is gravitationally discharged from the car's enclosure, it passes over the cam assemblies. Because the cam assemblies are rotationally actuated, however, turning or rotating the cam assemblies to seal the gate in a closed position imparts a self-cleaning to the actuators. Moreover, the overcenter design of the actuators allows them to releasably hold the gate in its closed position thereby avoiding inadvertent opening of the gate.

The lower seal structure for engaging the underside of the gate advantageously closes the opening required to allow for back and forth movements of the gate while concurrently inhibiting dirt, debris and other contaminants from fouling the discharge plenum. Arranging the lower seal in a channel on the frame of the gate and biasing the lower seal into engagement with the underside of the gate furthermore permits free vertical movements of the gate without detracting or departing from the sealing ability of the lower seal.

The edge seals on opposite sides of the gate furthermore contribute to the ability of the present invention to operate in a manner distinguishing this gate assembly from all others. As will be appreciated by those skilled in the art, the provision of side seals for pressing against opposite sides of the gate yields advantages to this gate assembly during both transport of the car and during unloading of the particulate matter from the enclosure of the hopper car.

These and numerous other objects, aims and advantages of the present invention will be readily and quickly appreciated from the following description, drawings and appended claims.

DETAILED DESCRIPTION OF THE DRAWINGS

DETAILED DESCRIPTION OF THE PRESENT INVENTION

Figure 1:
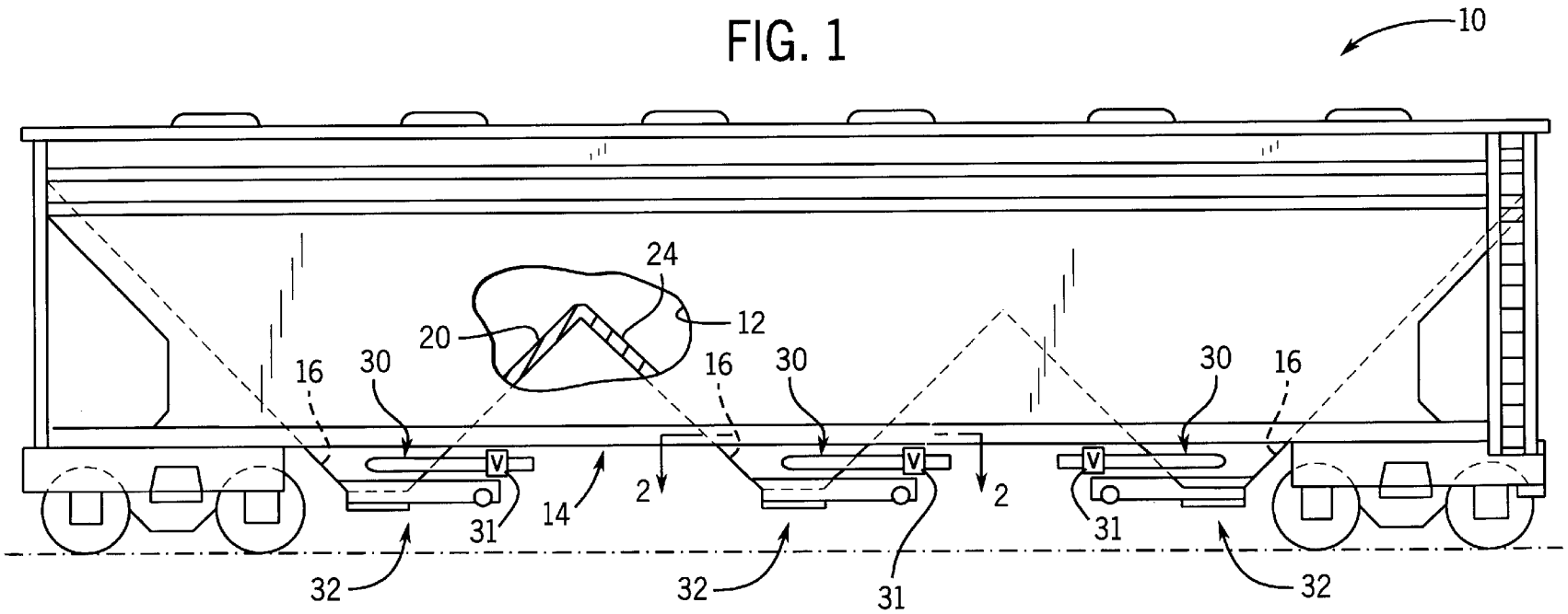
FIG. 1 is a partially sectioned side elevational view of the gate assembly of the present invention illustrated as attached to a covered railroad hopper car.

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Figure 2:
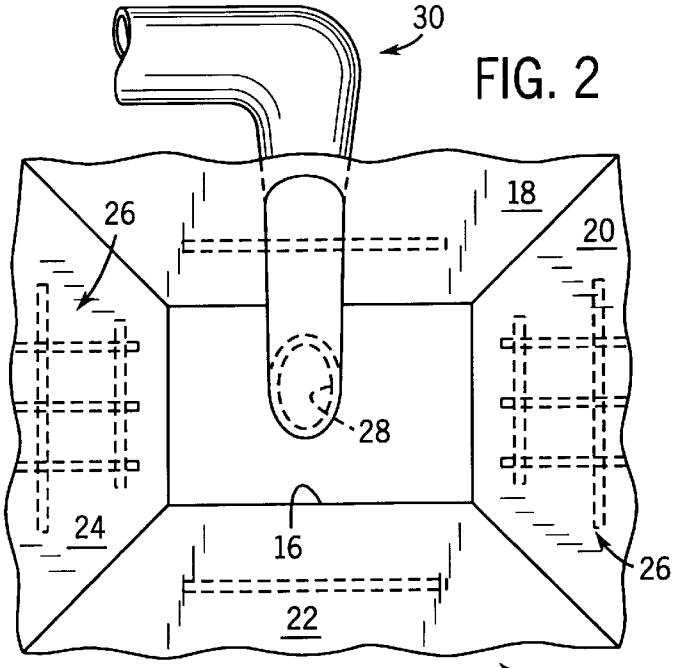
FIG. 2 is a sectional view taken along line 2—2 of FIG. 1.

Referring now to the drawings, wherein like reference numerals indicate like parts throughout the several views, there is illustrated in FIG. 1 a railroad hopper car 10 equipped with a series of gate assemblies according to the present invention. The basic structure of the hopper car 10 may be of any suitable design as such structure does not constitute a part of the present invention. Suffice it to say, the hopper car 10 includes a walled enclosure 12 wherein particulate matter is transported and stored. The hopper car 10 is provided, along a bottom 14 thereof, with a plurality of material unloading openings, generally indicated by reference numeral 16. As will be appreciated, more or fewer openings than those shown can be readily provided without detracting or departing from the spirit and scope of the present invention. As shown in FIG. 2, the walled enclosure 12 of hopper car 10 preferably includes four interconnected wall sections or slope sheets 18, 20, 22 and 24 funneling downwardly toward each opening 16 in the bottom 14 of the hopper car 10.

As is conventional and well known in the art, one or more permeable fluidizing members 26 can be arranged in combination with the slope sheets 18, 20, 22 and 24 for promoting discharge of particulate matter from the enclosure 14. The purpose of the fluidizing members 26 is to introduce pressurized air along the surface of the slope sheets 18, 20, 22 and 24 thereby fluidizing the particulate matter, thus, causing the particulate matter to gravitationally move toward the respective opening 16.

As schematically illustrated in FIG. 2, the hopper car 10 is furthermore provided with a pneumatically enabled outlet 28 arranged adjacent each opening 16 defined by the hopper car 10. As is well known in the art, the hopper car 10 is furthermore provided with a rigid conduit 30 extending generally horizontally and away from the outlet 28 and, as is conventional, includes a valve 31 (FIG. 1) for opening and closing the conduit 30. As is typical, a suitable suction hose (not shown) is connected to the free end of the conduit for effecting removal of particulate matter from the enclosure 12 of the hopper car 10 as a result of pressure differentials acting thereon. Notably, an internal gage pressure of about 15 psig. is to be established in the enclosure 14 of the hopper car 10 to effect discharge of particulate matter under or as a result of pressure differential acting on the particulate matter or material.

Figure 3:
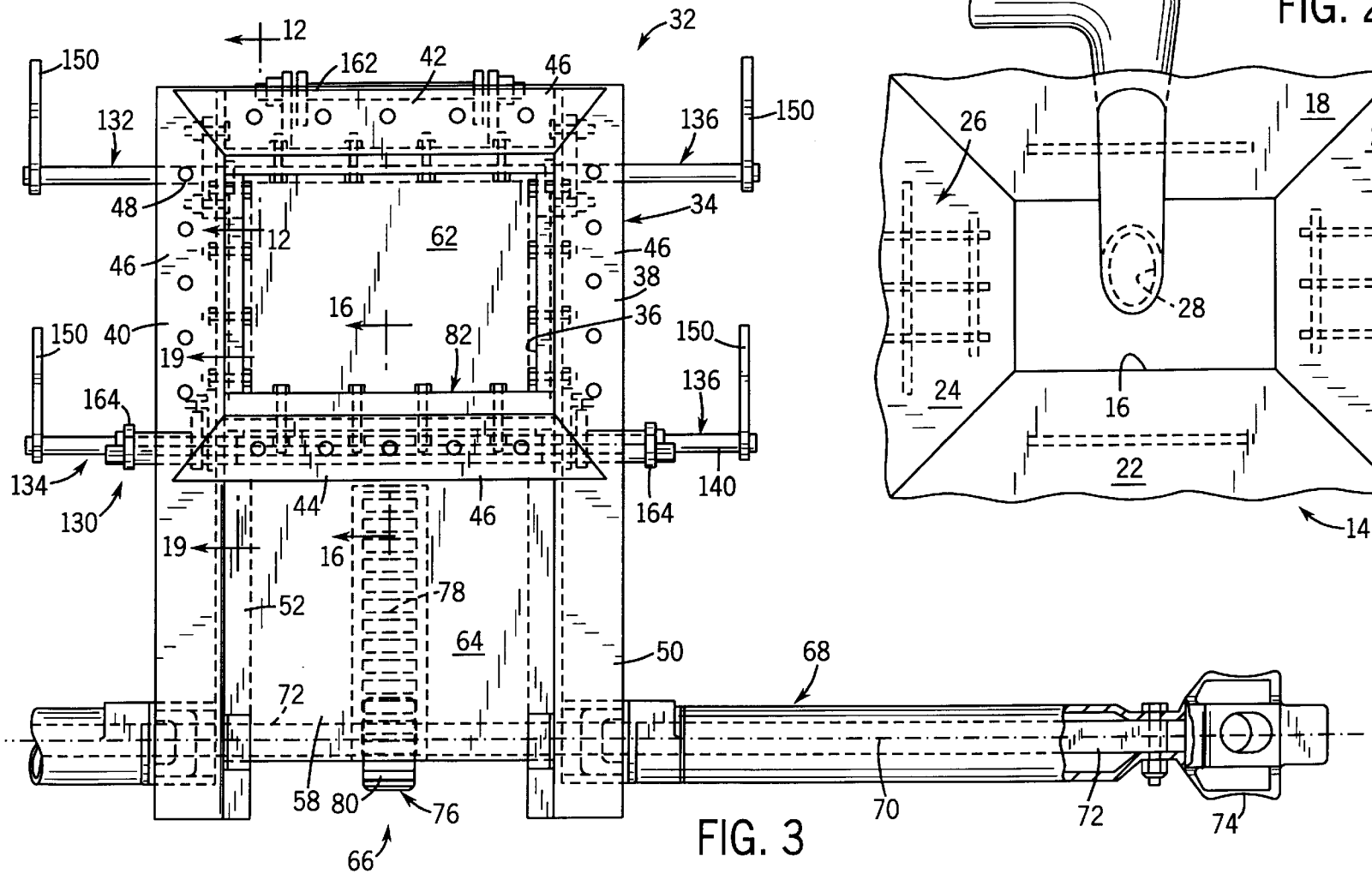
FIG. 3 is an enlarged top plan view of the gate assembly of the present invention removed from the hopper car.

According to the present invention, a gate assembly, generally indicated in FIG. 3 by reference numeral 32, is arranged in combination with each outlet or opening 16 on the bottom 14 of the hopper car 10. Since the gate assemblies arranged along the bottom 14 of the hopper car 10 are substantially identical relative to each other, only one gate assembly will be described in detail. Each gate assembly 32 includes a rigid frame 34 defining a discharge opening 36. Notably, when a gate assembly 32 is attached to the hopper car, the discharge opening 36 of the gate assembly 32 is arranged in registry with a respective unloading opening 16 on the hopper car 10.

As shown in FIG. 3, frame 34 includes opposed and generally parallel side walls 38, 40 extending lengthwise of the hopper car and opposed end walls 42,44 extending transversely across the hopper car. In the illustrated form of the invention, the disposition of the side walls 38, 40 and end walls 42, 44 is such that a trapezoidal or rectangularly shape is provided for the discharge opening 36. In a most preferred form of the invention, the discharge opening 36 is provided with a ledgeless configuration. That is, within an interior of the discharge opening 36 there is no frame structure or supports to interfere with the discharge or flow of particulate matter therethrough.

Figure 4:
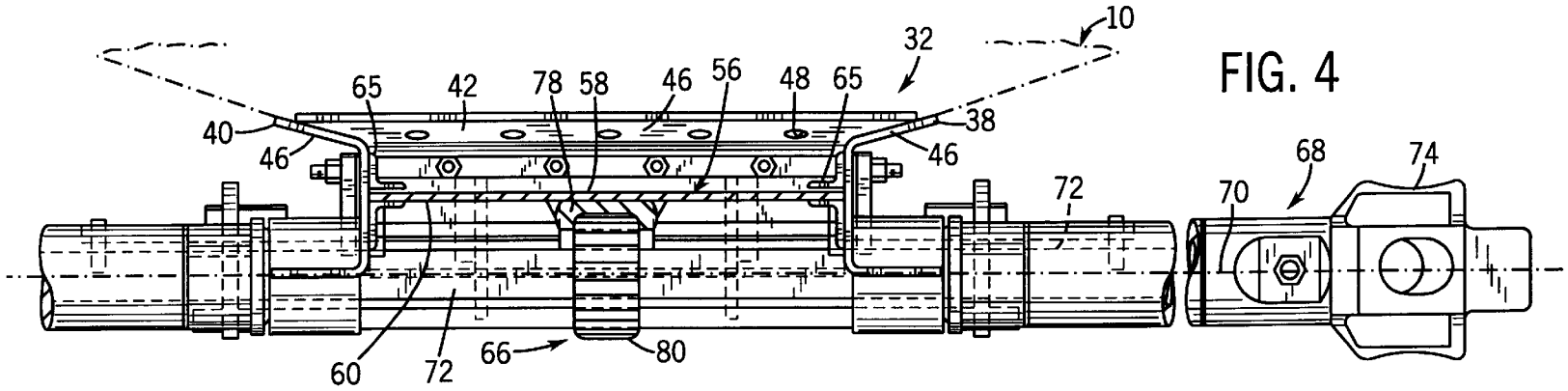
FIG. 4 is a rear elevational view of the gate assembly illustrated in FIG. 3.
Figure 5:
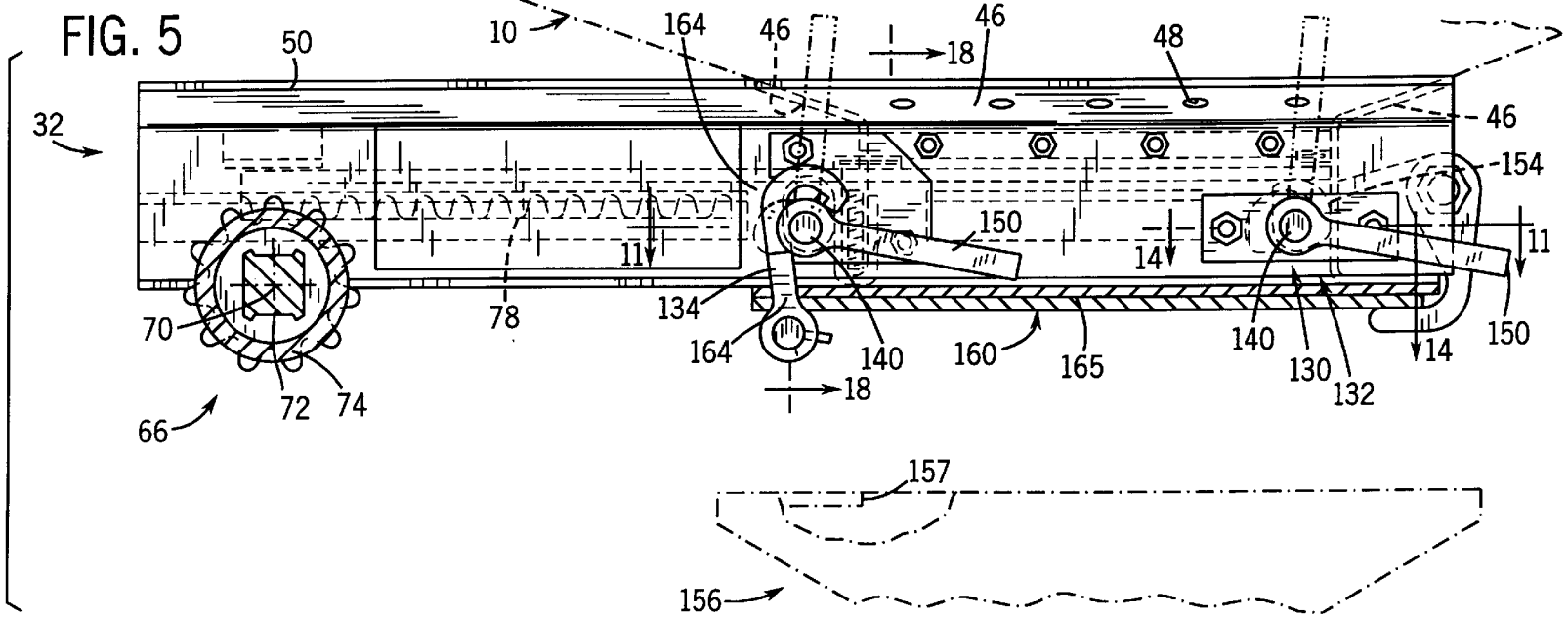
FIG. 5 is a side elevational view of the gate assembly illustrated in FIG. 3.

As shown in FIGS. 3, 4 and 5, each side wall 38, 40 and end wall 42, 44 has a mounting flange 46 formed at an upper end thereof. In a manner well known in the art, the flanges 46 toward the upper end of the walls 38 through 44 are configured to mate with respective portions of the hopper car 10 (FIGS. 3 and 4) to facilitate attachment of the gate assembly 32 to the hopper car. In one form, the flanges 46 define spaced holes 48 allowing for passage of suitable fasteners, such as bolts, therethrough.

Projecting away from the end wall 44 and extending lengthwise of the hopper car, frame 34 of gate assembly 32 further includes generally parallel frame extensions or supports 50 and 52. The frame extensions or supports 50, 52 support peripheral and opposed sides of a door or gate 56 for sliding movement on and relative to the frame 34.

As shown in FIGS. 3, 4 and 5, gate 56 has an elongated generally planar and rigid configuration including upper and lower surfaces 58 and 60, respectively. In the illustrated form of the invention, gate 56 has a generally rectangular configuration. As shown in FIG. 3, the lengthwise configuration of gate 56 is divisible into first and second sections or portions 62 and 64, respectively. The first lengthwise section 62 of gate 56 is slidable across the discharge opening 36 defined by frame 34 to effectively close the gate assembly 32. The second lengthwise section 64 of gate 56 is supported by the extensions 50, 52 of frame 34. Notably, and as shown in FIG. 4, the extensions 50, 52 of frame 34 each include an elongated retainer 65 disposed above and preferably extending substantially the entire length of the second lengthwise portion 64 of the gate 56 and which is vertically spaced from the respective support 50, 52 to entrap the side edges of the gate 56 therebetween. Thus, the gate 56 is prevented from tipping relative to the frame 34 (due to lack of frame support structure within the discharge opening 36) when in its closed position furthermore allowing for a ledgeless design in the discharge opening 36 of the frame 34.

Figure 16:
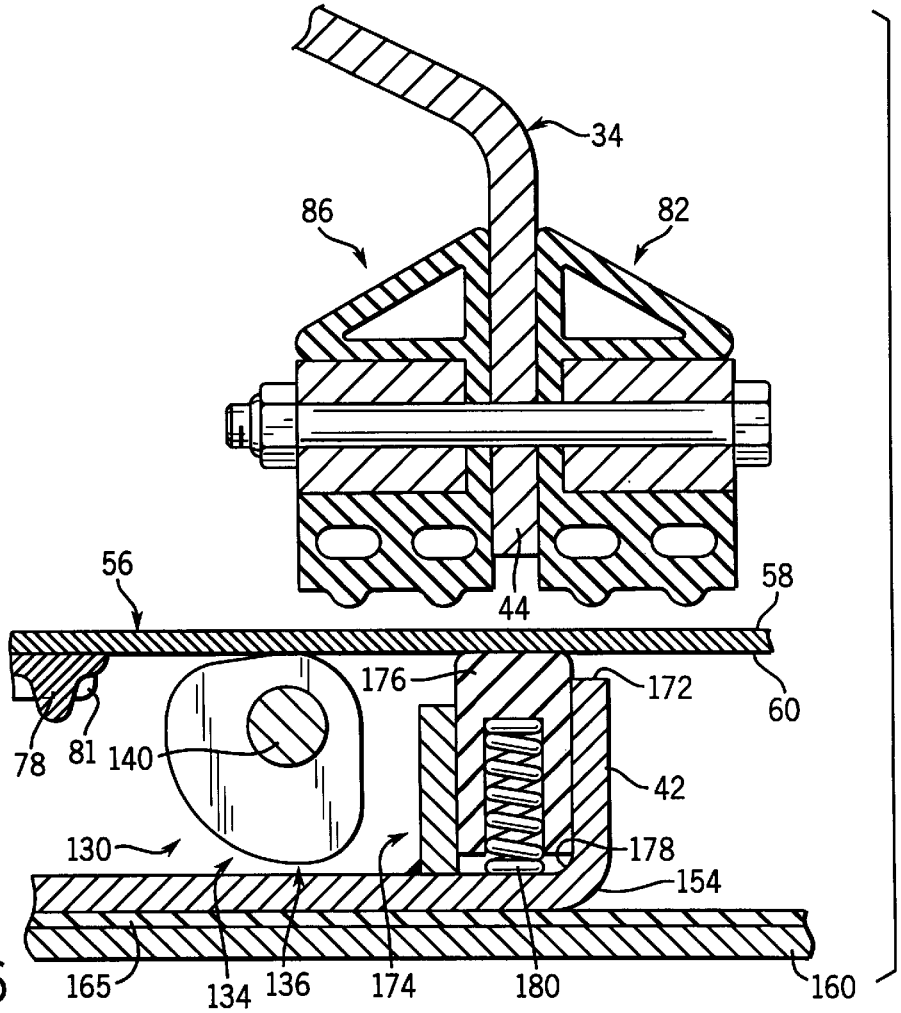
FIG. 16 is an enlarged sectional view taken along line 16—16 of FIG. 3 but showing the gate of the gate assembly in a sealed condition.

Each gate assembly 32 is furthermore provided with a drive mechanism 66 for moving the gate 56 between its closed and open positions relative to the discharge opening 36 on the frame 34. In the embodiment illustrated in FIGS. 3, 4 and 5, the drive mechanism 66 includes an elongated operating shaft assembly 68 mounted on the frame 34 of the gate assembly 32 for rotation about a fixed generally horizontal axis 70 extending transversely across the longitudinal axis of the hopper car and beneath the gate 56. As is conventional, the operating shaft assembly 68 includes an elongated operating shaft 72 having operating handles or capstans 74 connected to opposite ends thereof (with only one capstan being shown in the drawings). The operating shaft 72 is operably connected to the gate 56 as through a rack and pinion assembly 76. The rack and pinion assembly 76 includes an elongated rack 78 secured to the underside or bottom 60 of the second lengthwise section 64 of the gate 56. A pinion gear 80 is secured to the shaft 72 to rotate therewith. The pinion gear 80 is maintained in meshing engagement with the rack 78 such that when rotational movement is imparted to the shaft 72, the gate 56 slidably moves relative to the frame 34; with the direction of gate movement being controlled through the direction of rotation of the shaft 72. As shown in FIG. 16, a stop 81 is provided in relation to the rack 78 on the underside 60 of the gate 56 for limiting horizontal movement of the gate 56 toward an open position.

According to one aspect of the present invention, the gate assembly 32 further includes seal structure 82 arranged in complete surrounding relation relative to the discharge opening 36 defined by the frame 34 of gate assembly 32. In a preferred form of the invention, the seal structure 82 is carried on the frame 34 of the gate assembly 32. It is within the spirit and scope of the present invention, however, that the seal structure 82 could be mounted on the gate 56 and movable therewith into sealing relationship relative to the frame 34 of the gate assembly 32 to seal the gate 56 closed.

Figure 6:
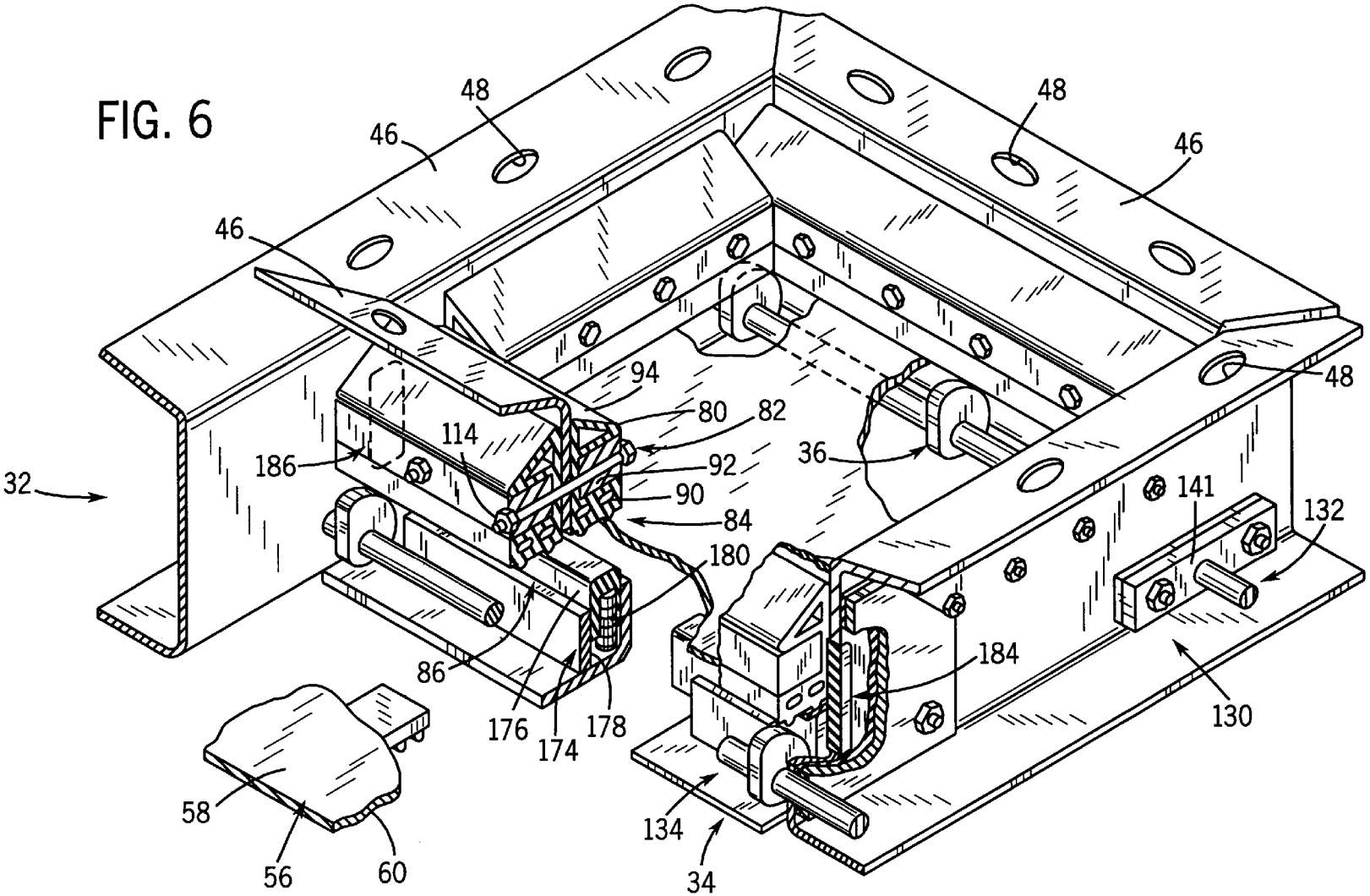
FIG. 6 is a perspective view of the gate assembly of the present invention with parts and components being sectioned to better illustrate various components and structures of the gate assembly.

As shown in FIG. 6, the seal structure 82 preferably includes an elastomeric seal 84 extending to the interior of and completely about the discharge opening 36 defined by the frame of the gate assembly 32. The primary purpose of the seal 84 is to hold a gage pressure of about 15 psig. within the enclosure 12 (FIG. 1) of the hopper car 10 during unloading of the particulate matter.

In a preferred form of the invention, seal structure 82 further includes an outer elastomeric seal 86 extending to the exterior of the frame 34 and across the upper surface 58 of the gate 56 when the gate 56 is in a closed position. As shown, the outer seal 86 is arranged in combination with and extends generally parallel to the end wall 44 of the frame 34. The primary purpose of the outer seal 86 is to inhibit contamination and insect infiltration between the frame 34 and the upper surface 58 of the gate 56 to the enclosure 12 (FIG. 1) during transport and storage of the railroad hopper car 10.

Figure 7:
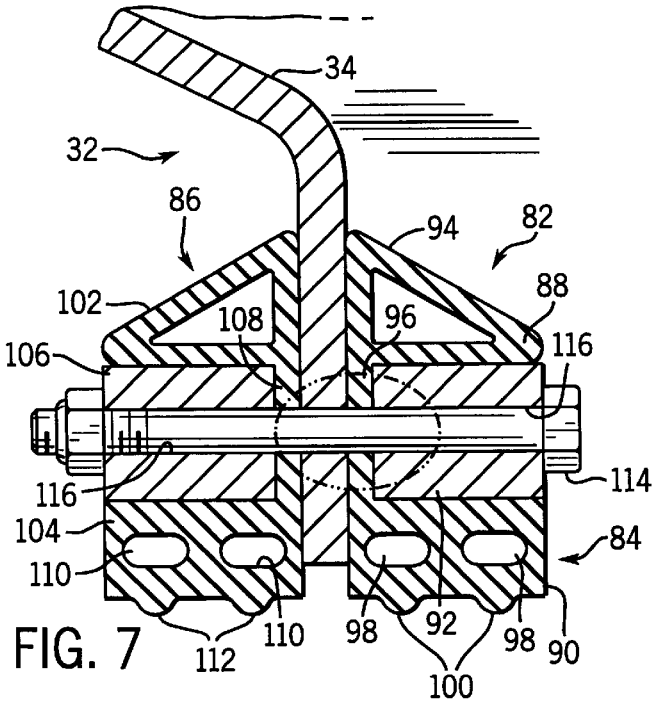
FIG. 7 is an enlarged sectional view illustrating upper seal structure forming part of the present invention.

In a preferred form, and as shown in FIG. 7, seal 84 includes upper and lower sections 88 and 90, respectively, with a rigid material member or bar 92 extending therebetween. The purpose of the rigid material member 92 on the seal 84 is to add strength and rigidity thereto.

Notably, the upper section 88 of seal 84 preferably includes a slanted or downwardly sloping upper surface 94 to promote movement of particulate matter therepast. In a most preferred form of the invention, the upper and lower sections 88 and 90, respectively, of the seal 84 are integrally joined to each other by a web 96. To enhance its compressibility, the lower section 90 of seal 84 is preferably configured with one or more closed channels 98 extending longitudinally of the seal 84 thereby adding a hollow configuration to the lower portion 90 of the seal 84. Moreover, the lower section 90 of the seal 84 is preferably provided with a pair of spaced ribs or ridges 100 extending longitudinally thereof and which are adapted to engage with the upper surface 58 of the gate 56 when the gate 56 is in a closed position.

As shown in FIG. 7, seal 86 includes upper and lower sections 102 and 104, respectively, with a rigid member 106 disposed therebetween. The purpose of the rigid member 106 is to add strength and rigidity to the seal 86. In a preferred form of the invention, the upper and lower sections 102 and 104 of seal 86 are integrally joined to each other by a web 108. To enhance compressibility thereof, the lower section 104 of the seal 86 is configured with one or more closed channels 110 extending longitudinally of the seal 86. Moreover, the lower section 104 of seal 84 is preferably provided with a pair of spaced ribs or ridges 112 extending longitudinally of the outer seal 86 and which engage the upper surface 58 of the gate 56 when the gate 56 is in a closed position.

Because the particulate matter transported and held within the enclosure 12 (FIG. 1) of the hopper car 10 can constitute food grade quality materials, the elastomeric material used in fabricating the seal structure 82 is of the type approved by the FDA and conform to the FDA Food Contact Requirements. In the illustrated form of the invention, the elastomeric portion of each seal 84, 86 is fabricated from ultra high molecular weight polyethylene having a durometer hardness in the 60 to 70 Shore A range while the rigid material member or bar 92, 106 of the inner and outer seals 84, 86, respectively, is preferably formed from stainless steel or other FDA approved materials.

As shown in FIGS. 6 and 7, the seals 84, 86 are attached to the frame 34 of the gate assembly 32 with a plurality of suitable fasteners 114 preferably including a conventional elongated bolt and nut assembly. In a preferred form of the invention, each rigid material member 92 and 106 of the inner and outer seals 84 and 86, respectively, is provided with a throughbore 116 permitting passage of the fastener 114 therethrough. Alternatively, one or both of the seals 84, 86 of seal structure 82 could be adhered to the frame 34.

Figure 8:
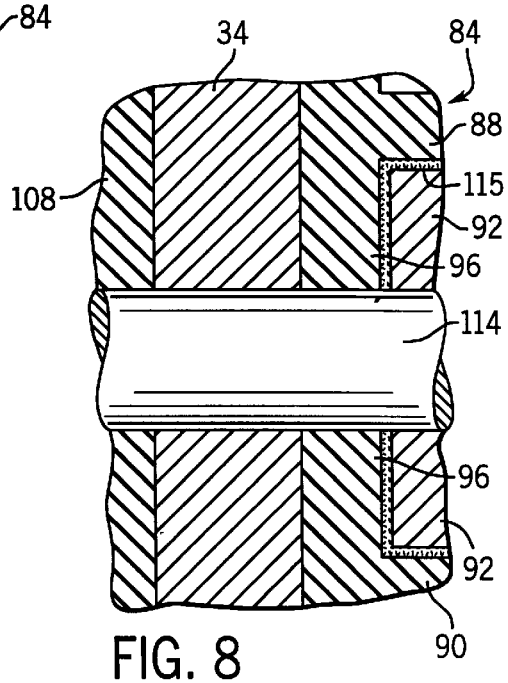
FIG. 8 is an enlarged view of that area encircled in phantom lines in FIG. 7.

As shown in FIG. 8, seal 84 of the seal structure 82 is further fastened to the frame 34 of the gate assembly 32 with an adhesive 115 disposed between the seal and the rigid metal member 92. As will be appreciated by those skilled in the art, when the seal 84 is securely fastened to the frame 34 of the gate assembly 32, the web 96 of the seal, compresses about the portion of the bolt diameter extending therethrough thereby creating a seal about the fastener 114 to inhibit contaminants from penetrating past the seal structure 82. Because the particulate matter transported and held within the enclosure 12 (FIG. 1) of the hopper car 10 can constitute food grade or quality materials, the adhesive 115 used to adhere the seals 84, 86 to the rigid material member 92 constitute an FDA approved adhesive such as CSS Multi-Bond 1346 conforming to FDA Food Contact Requirements.

Figure 9:
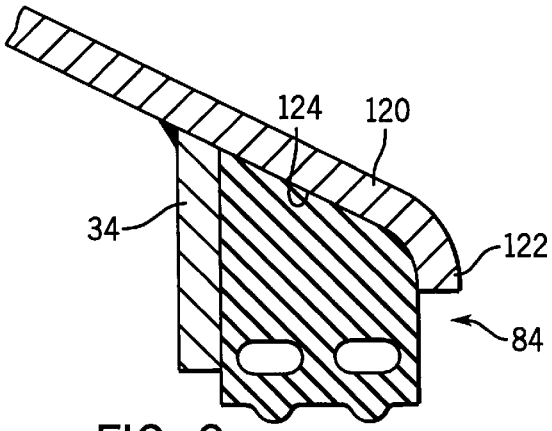
FIG. 9 is an alternative embodiment for the upper seal structure illustrated in FIG. 7.

An alternative embodiment for the inner seal 84 is illustrated in FIG. 9. In this form, the frame 34 of the gate assembly 32 is configured as described above but further includes an inwardly directed flange portion 120 having a generally vertical lip or skirt 122 to define a cavity or open bottom channel 124 for accommodating and holding the elastomeric portion of the inner seal 84. In this form of the invention, the inwardly directed flange portion 120 of the seal has a downwardly slanting configuration to promote movement of particulate matter therepast.

Figure 10:
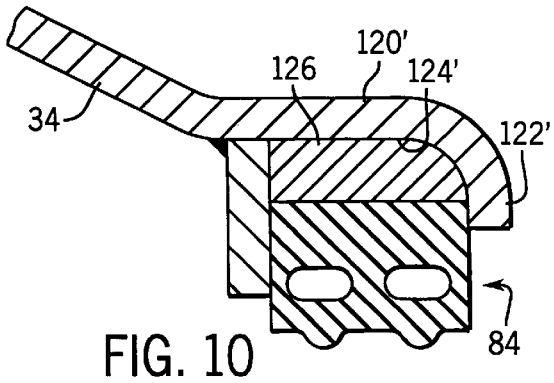
FIG. 10 is another alternative embodiment for the upper seal structure illustrated in FIG. 7.

Yet another embodiment of seal 84 is illustrated in FIG. 10. This embodiment of the seal 84 is similar to that illustrated in FIG. 9 except the inwardly directed flange portion 120' of the frame 34 extends generally horizontal and includes a generally vertical lip or skirt 122' to define a open bottom lower channel 124'. The embodiment of the seal 84 illustrated in FIG. 10 moreover preferably includes a spacer 126 disposed in the channel 124' for vertically positioning the seal 84 relative to the upper surface 58 of gate 56.

Figure 11:
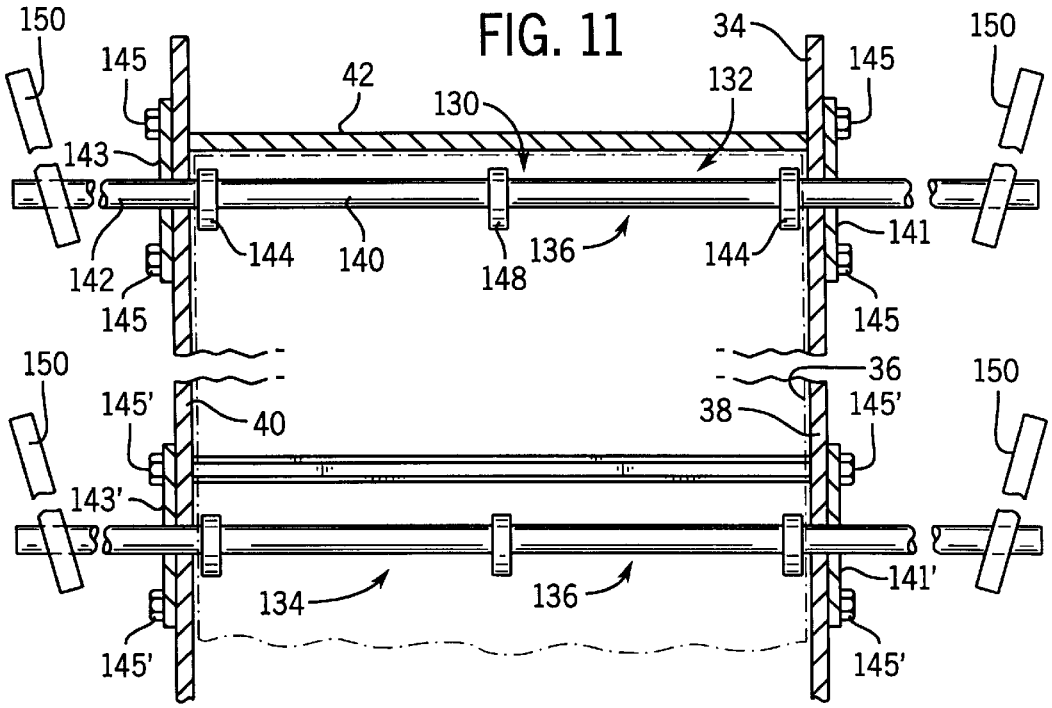
FIG. 11 is a sectional view taken along line 11—11 of FIG. 5.

As shown in FIGS. 3, 5 and 6, gate assembly 32 further includes a mechanism 130 for urging the gate 56 into engagement with the seal structure 82 when the gate 56 is in a closed position to enable the enclosure 12 (FIG. 1) of the hopper car to be pressurized with up to about 15 psig. Gate 56 is carried on the frame 34 for generally vertical movement between sealed and unsealed positions. As shown in FIG. 11, the actuating mechanism 130 for elevationally positioning the gate 56 includes a series of rotatable actuators 132 and 134 disposed beneath the gate 56 on the frame 34. The actuating mechanism 130 is operable in a first condition whereby the gate 56, the seal structure 82 and the frame 34 of the gate assembly 32 establish, in combination relative to each other, a sealed relationship about the discharge opening 36 of the gate assembly 32. The actuating mechanism 130 is further operable in a second condition whereby the gate 56 is vertically lowered and can be moved to an open position.

The rotatable actuators 132, 134 are each generally horizontally disposed and are horizontally spaced from each other so as to be adjacent the end walls 42, 44 (FIGS. 12 and 16, respectively) partially defining the discharge opening 36 on the frame 34 of the gate assembly 32. In the illustrated form of the invention, the rotatable actuators 132, 134 are substantially similar to each other in construction and, thus, only actuator 132 will be described in detail.

Figure 12:
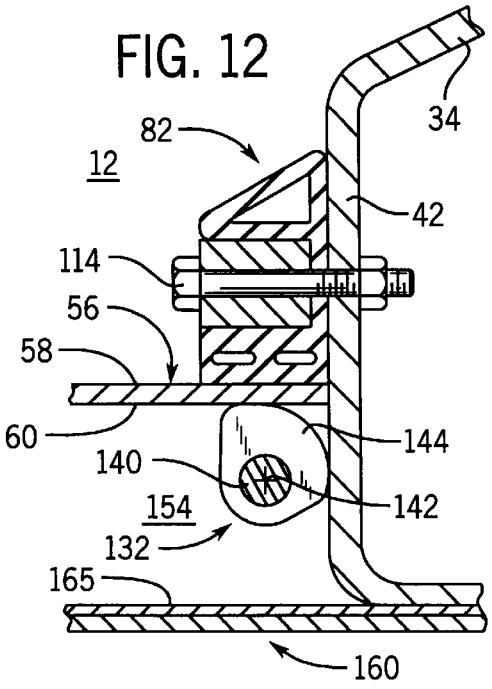
FIG. 12 is an enlarged sectional view taken along line 12—12 of FIG. 3 showing a gate of the gate assembly in a sealed condition.
Figure 13:
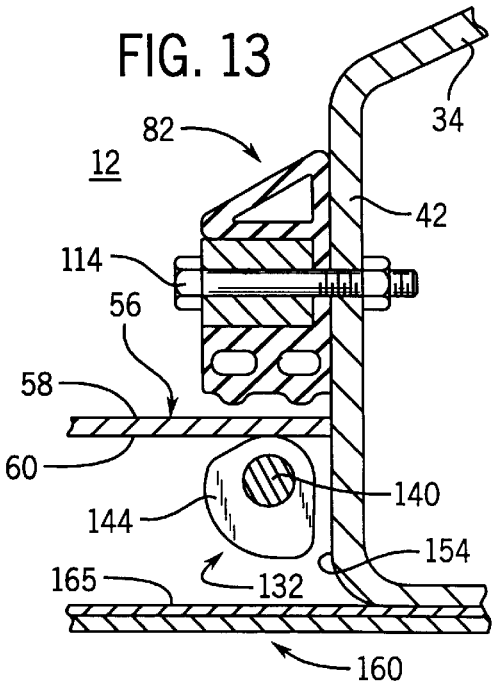
FIG. 13 is a sectional view similar to FIG. 12 but showing the gate of the gate assembly in an unsealed condition.

As shown in FIG. 11, the rotatable actuator 132 is preferably configured as a rotatable cam assembly 136. As shown in FIG. 12, each cam assembly 136 is rotatable between a position engaging the underside 60 of the gate 56 to press the gate 56 against the seal structure 82 with sufficient force to allow an increased gage pressure of up to about 15 psig. to be established within the enclosure 12 of the hopper car. Turning to FIG. 13, each cam assembly 136 is rotatable to a position whereby the gate 56 is elevationally lowered to permit movement of the gate 56 to an open position without any detrimental effect on the seal structure 82.

Returning to FIG. 11, each cam assembly 136 preferably includes an elongated shaft 140 defining a fixed rotational axis 142 extending laterally across and beneath the longitudinal axis of the gate 56. Shaft 140 is preferably journalled for rotation in bearing plates 141 and 143 fastened to the opposite side walls 38 and 40 of frame 34 as with suitable, and preferably, threaded fasteners 145 capable of developing various clamping forces as a function of the torque level applied thereto. Eccentric actuators or cams 144 and 146 are arranged in axially spaced relation along the length of the shaft 140. The cams 144, 146 are fixed to rotate with and are identically disposed on the shaft 140.

As shown in FIG. 11, the cams 144, 146 are preferably disposed closely adjacent the side walls 38, 40 of the frame 34 to engage the opposed sides of the gate 56. In an alternative form of the invention, each cam assembly 136 furthermore includes a third eccentric actuator or cam 148 disposed along the length of the shaft 140 proximate midlength thereof for supporting and engaging a midportion of the gate 56. As will be appreciated by those skilled in the art, shaft 140 is rotatably supported about midlength thereof by a suitable frame support structure to withstand the forces applied thereto by the third cam 148. As best illustrated in FIG. 12, the vertical distance separating axis 142, about which the actuators rotate, from the axis of the fastener 114, used to secure the seal structure 82 to the frame 34 of the gate assembly 32, is carefully controlled to effect an optimum sealing relationship between frame 34, gate 56 and the sealing structure 82 when the gate 56 is elevated into a sealed operative position.

Figure 14:
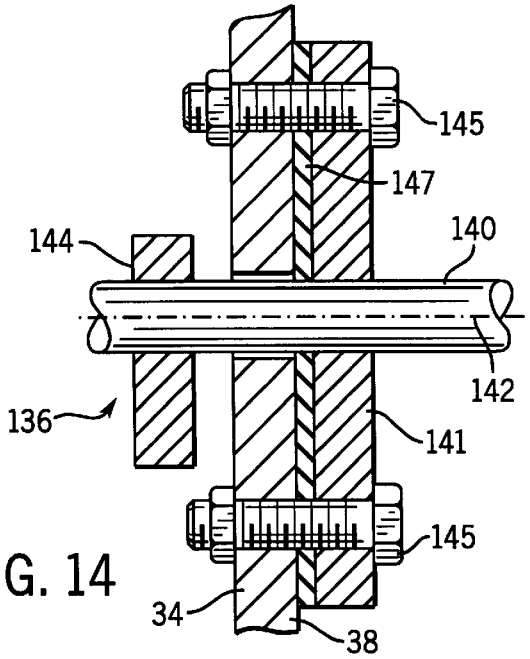
FIG. 14 is an enlarged sectional view taken along line 14—14 of FIG. 5.

In a preferred form of the invention, each cam assembly 136 is sealed to inhibit debris, dirt and dust from passing along and between the elongated shaft 140 of cam assembly 136 and the respective wall of frame 34 of gate assembly 32. As shown in FIG. 14, a Nitrile FDA approved seal 147 is entrapped between the respective wall of frame 34 and a respective bearing plate used to journal the shaft 140 for rotation on the frame 34. In a most preferred form of the invention, the seal 147 has a durometer hardness of about a 60 Shore A.

Each cam 144, 146 and 148 of cam assembly 136 has an eccentric relationship relative to axis 142 of the shaft 140 on which it is mounted. Moreover, each cam 144, 146 and 148 is configured to allow the cam assembly 136 to operate as an overcenter mechanism. That is, when the cam assembly 136 is rotated in a clockwise direction from the position schematically illustrated in FIG. 13 toward the position schematically illustrated in FIG. 12, each cam 144, 146 and 148 in association with the cam assembly will continue to urge or elevate the gate 56 to a predetermined height relative to the seal structure 82 and then move to an overcenter position.

In the overcenter position, the cam assembly 136 is inhibited from inadvertently rotating in a counterclockwise direction. Moreover, the spring or resilient force inherent with the seal structure 82 pressing downwardly upon the gate 56 further inhibits the cam assembly 136 from turning or rotating in a counterclockwise direction. As such, and when moved into a position shown in FIG. 12, the rotational actuators 132, 134 furthermore operationally serve as releasable locks for inhibiting inadvertent horizontal movement of the gate 56 toward an open position. Notably, and as will be appreciated from FIG. 12, the eccentric configuration of the cams 144, 146 and their disposition relative to the frame 34 of gate assembly 32 limits rotation of the cam assemblies 136 to an operative arc effective to enable sealing and unsealing of the gate 56 while preventing over rotation of the cam assemblies 136 in a manner adverse to proper operation of the rotatable actuators 132, 134.

Returning to FIGS. 3 and 5, and to actuate mechanism 130, each cam assembly 136 is furthermore provided with an operating handle 150 preferably pivotally mounted at opposite ends of shaft 140. Each handle 150 is disposed for operation externally of the frame 34 of the gate assembly.

Although illustrated as being independently operable, it will be appreciated by those skilled in the art that the handles 150 of the cam assemblies 136 could be operated conjointly with each other without detracting or departing from the spirit and scope of the present invention.

As shown in FIG. 5, the side walls 38, 40 and end walls 42, 44 of frame 34 depend from the discharge opening 36 to define a plenum chamber 154 for the gate assembly 32. As is conventional, the lower ends of walls 38 through 44 of gate assembly 32 have an outwardly flared configuration to permit a conventional discharge apparatus 156 to be operably coupled thereto. Suffice it to say, the discharge sled 156 (also commonly referred to as an air sled) may be the type disclosed in one or more of the following U.S. Pat. Nos. 2,376,814; 2,517,837; 2,527,455; 2,527,466; 2,589,968; 2,657,100; 2,675,274; 2,681,748; 2,789,739. The full disclosure of these patents is incorporated herein by reference. Alternatively, the dischrage apparatus may be a simple compression boot or chamber that draws particulate matter or commodity to a storage reservoir.

To inhibit smoke, dirt, dust and related debris from contaminating the discharge plenum 154, a cover or sanitary plate 160 is arranged in operable combination with the flanged configuration on the frame 34 of the gate assembly 32. Cover 160 has a planar configuration which, in a closed position, snugly fits against the flanged configuration defined by the frame 34 of the gate assembly 32 to close the discharge plenum 154. In the illustrated form of the invention, the cover or plate 160 is mounted for pivotal movement relative to the discharge plenum 154 about a generally horizontal axis 162 (FIG. 3) extending generally parallel to the discharge gate 56. Opposite the end at which the cover 160 is pivotally mounted for movement, opposite lateral sides of cover 160 are provided with a free turning latch 164. Preferably, latch 164 is used to releasably secure the cover or plate 160 in a latched or open position by hooking the free end 166 of the latch 164 to a suitable point or location on the hopper car 10 thereby permitting flow of particulate matter from the discharge opening 36 and through the discharge plenum 154 without the cover 160 interfering therewith.

In the illustrated form of the invention, and as shown in FIG. 5, cover 160 includes a seal 165 extending entirely thereacross and thereover. Seal 165 is arranged on that surface of cover 160 to be pressed against the flanged structure of the frame 34 to enhance the sealing relationship between the cover 160 and the frame 34 of gate assembly 32. Seal 165 is preferably a Nitrile FDA approved closed cell sponge gasket. Seal 165 is adhered to the cover 160 with an FDA approved adhesive. The closed cell Nitrile seal 165 prevents water absorption while conforming to FDA Food Contact requirements.

Another aspect of the present invention relates to the ability of the cover 160 to be moved into sealing relationship relative to the frame 34 of the gate assembly 32 in timed relation relative to the frame 34, gate 56 and seal structure 82 being sealed relative to each other. In the illustrated form of the invention, the rotatable actuator 134 of the seal actuating mechanism 130 is capable of both establishing a sealed relationship between the frame 34, the upper surface 58 of gate 56 and the sealing structure 82 while generally simultaneously moving the cover 160 into sealing closed relationship relative to the flanged structure on the frame 34 of the gate assembly 32.

Figure 15:
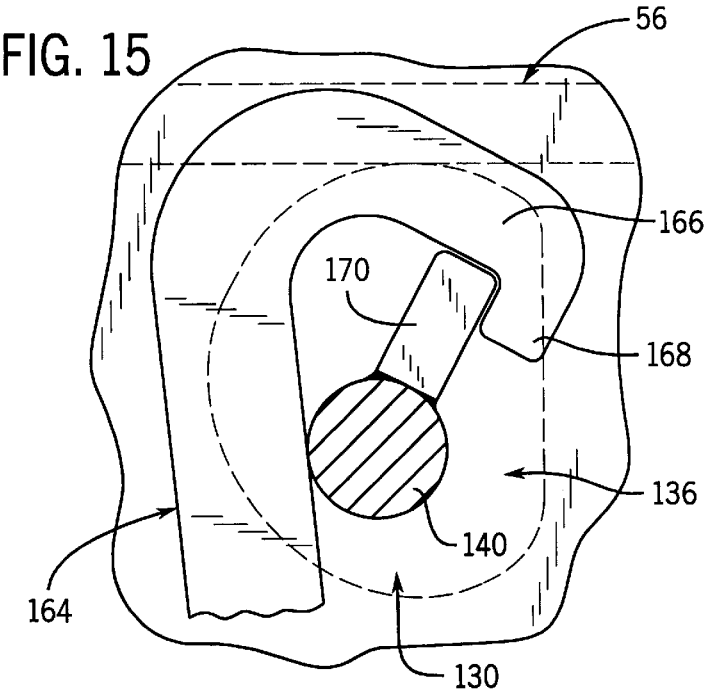
FIG. 15 is an enlarged side elevational view of that area encircled in phantom lines in FIG. 5.

As shown in FIGS. 5 and 15, the free end 166 of each latch 164 is configured with a generally "J" or hook-like configuration. The distal end 168 of each latch 164 is configured to engage and cooperate with a projection 170 radially extending outwardly from the elongated shaft 140 of actuating mechanism 130. As will be appreciated, when the latch 164 is in the vertical disposition illustrated in FIGS. 5 and 15, the free end 166 thereof fits over the projection 170. Upon initial rotation of the actuating mechanism 130, the distal end 168 of each latch 164 is engaged by the respective projection 170 on shaft 140 of actuator 134. Further rotation of the actuator 134 causes the latch 164 to raise the cover 160 thereby sealing the discharge plenum 154 while the frame 34, gate 56, and the seal structure 82 are likewise urged into sealing relationship relative to each other thereby sealing the gate assembly 32 closed.

As will be appreciated by those skilled in the art, the end wall 44 of frame 34 of the gate assembly 32 is required to have an opening or elongated slot 172 (FIGS. 16 and 17) disposed below the seal structure 82 to allow for horizontal movement of the gate 56 between open and closed positions. In the illustrated form of the invention, the opening or elongated slot 172 has a vertical dimension greater than the thickness of the gate 56 to allow for vertical elevation and lowering of the gate 56 in the manner described above.

As will be appreciated from an understanding of the structure described above, the opening 172 provides a conduit or passage, extending across and along the entire underside or lower surface 60 of the gate 56. This opening 172 normally allows dirt, dust, smoke, water and related debris to enter and, thus, contaminate the discharge plenum 154 of gate assembly 32. Still another aspect of the present invention relates to providing a lower seal 174 resiliently and continuously urged into engagement with that portion of the underside or lower surface 60 passing through the end wall 44 of the frame 34 in a manner effectively sealing the opening 172 while allowing for vertical displacement of the gate 56.

As illustrated in FIG. 16, in one form of the invention, the lower seal 174 includes an elongated, preferably one-piece, seal bar 176 extending across the entire width of the gate 56 between opposed sides thereof The seal bar 176 is preferably fabricated from ultra-high molecular weight polyethylene. As shown, the seal bar 176 is resiliently urged against the underside or lower surface 60 of the first lengthwise gate section 62.

In the illustrated form of the invention, the end wall 44 of the frame 34 of gate assembly 32 is provided with an open top elongated channel 178 sized to snugly accommodate the seal bar 176 while allowing for vertical reciprocatory movements thereof. In a preferred form of the invention, a series of laterally spaced springs 180 are accommodated within the channel 178 along the length of and beneath the seal bar 176 for resiliently and continuously urging the seal bar 176 into sealing engagement with the underside or lower surface 60 of the gate 56. As will be appreciated, the springs 180 readily permit the gate 56 to be vertically elevated between unsealed and sealed conditions (FIGS. 16 and 17, respectively), without detracting from the sealing relationship between the gate 56 and the seal 174 thereby inhibiting contamination of the discharge chamber or plenum 154 of the gate assembly 32.

Figure 16A:
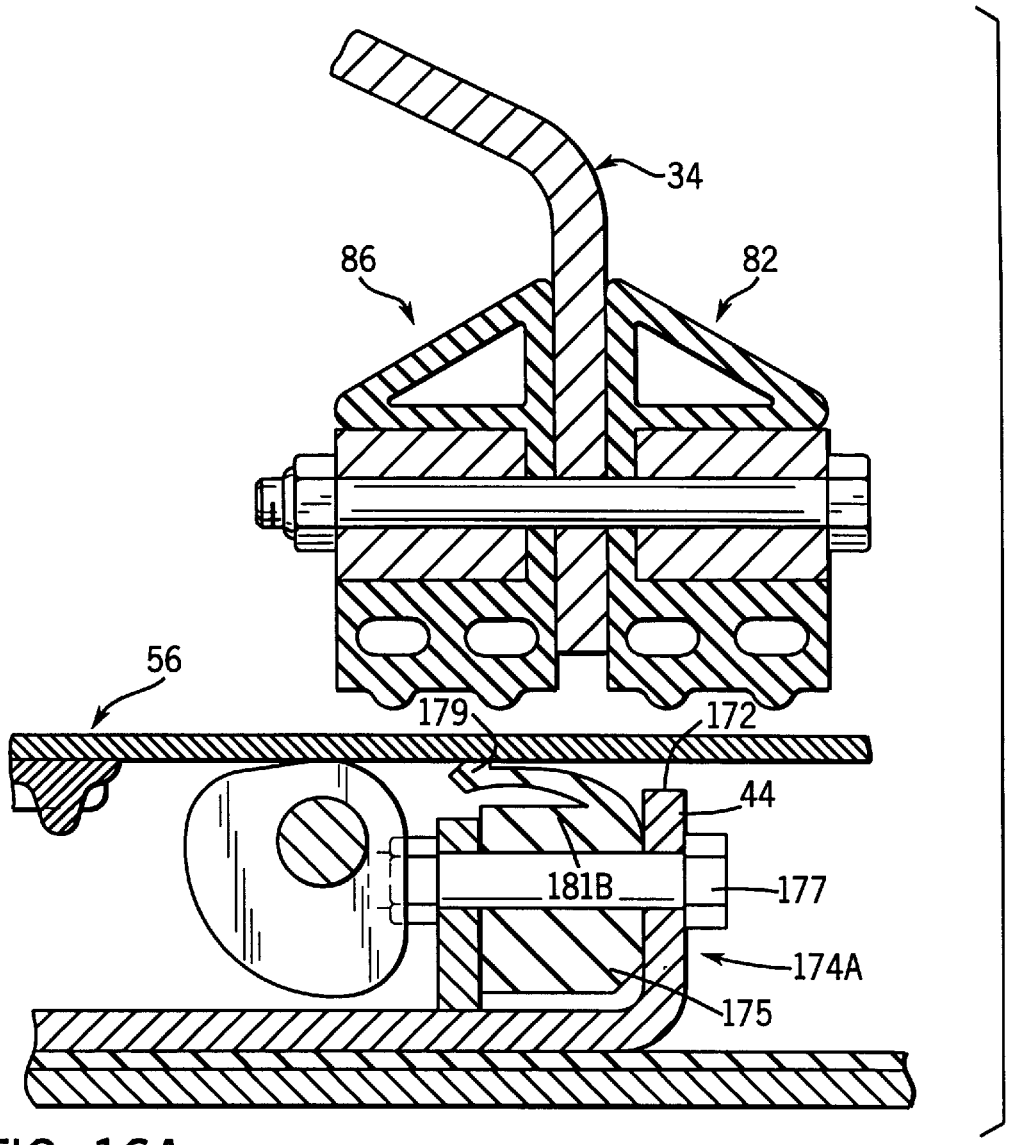
FIG. 16A illustrates an alternative form of lower seal for the present invention.

An alternative form of lower seal 174 is schematically illustrated in FIG. 16A. This alternative form of lower seal is designated generally by reference numeral 174A. In this embodiment, the lower seal 174A is configured as a wiper seal including an attachment portion 174 which is affixed to wall 44 of frame 34 beneath the bottom surface 60 of gate 56. As shown, a suitable fastener 177 passes through the attachment portion 175 of seal 174A to secure the seal 174A to the frame 34 of the gate assembly 32. Alternatively, an adhesive could be used to secure the seal 174A to the frame 34 of the gate assembly 32. Seal 174A further includes a wiper blade extension 179 projecting away from the attachment portion 175 of the seal 174A. In the illustrated form of the invention, th wiper extension 179 and attachment portion 175 are integrally formed as part of seal 174A. The wiper extension 179 extends the full width of the gate 56. Notably, the wiper extension 179 is resiliently biased against the bottom surface 60 of the gate 56 to allow for vertical displacements of the gate 56 while maintaining a sealed relationship therewith thereby sealing closed the opening 172 in the frame 34 of the gate assembly 32.

Figure 16B:
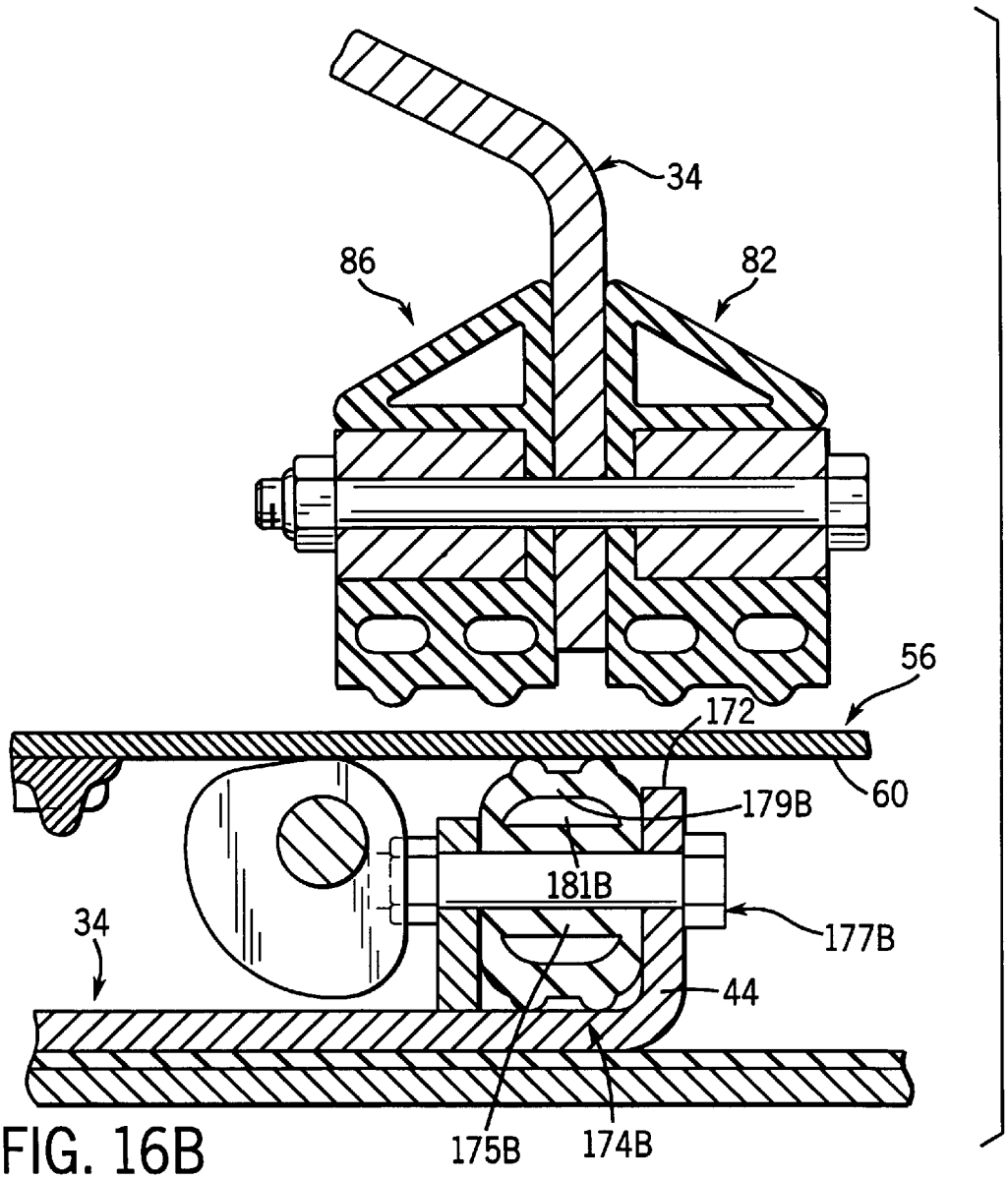
FIG. 16B illustrates still another form of lower seal for the present invention.

Another alternative form of lower seal is schematically illustrated in FIG. 16B. This alternative form of lower seal is designated generally by reference numeral 174B. In this embodiment, the lower seal 164B is configured as a wiper seal including an attachment portion 175B which is affixed to the wall 44 of frame 34 beneath the bottom or lower surface 60 of gate 56. As shown, a suitable fastener 177B passes through the attachment portion 175B of seal 174B to secure the seal 174B to the frame 34 of the gate assembly 32. Alternatively, an adhesive could be used to secure the seal 174B to the frame 34 of the gate assembly 32. Seal 174B further includes a resilient wiper extension 179B. Notably, an elongated longitudinally extending closed channel 181B is disposed between the wiper extension 179B and the attachment portion 175B. The wiper extension 179B extends the full width of the gate 56. As will be appreciated by those skilled in the art, the wiper extension 179B is resiliently biased and seals against the bottom surface 60 of the gate 56 to allow for vertical displacement of the gate 56 relative to the frame 34 while maintaining a sealed relationship therewith thereby sealing closed the opening 172 in the frame 34 of the gate assembly 32. In the illustrated form of the invention, the seal 174B is configured to be reversible thereby enhancing the life expectancy of the seal 174B.

Notably, the seal configuration illustrated in FIGS. 16A and/or 16B could likewsie be substituted for the outer seal 86 of seal structure 82 without detracting or departing from the spirit and scope of the present invention.

As illustrated in FIG. 6, another aspect of the present invention relates to providing side or edge seals 184 and 186 which are biased against opposed side edges of the gate 56 when the gate 56 is in any position. The edge seals 184 and 186 are substantially identical to each other. Accordingly, only seal 184 will be described in detail.

Figure 18:
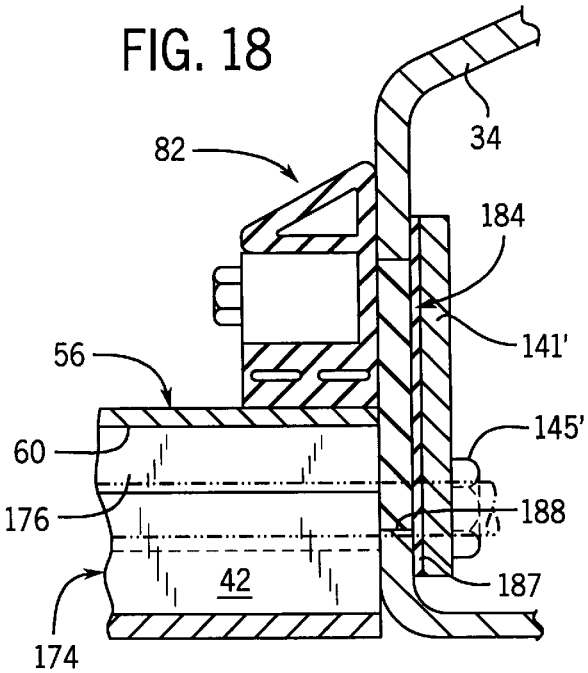
FIG. 18 is an enlarged sectional view taken along line 18—18 of FIG. 3.
Figure 19:
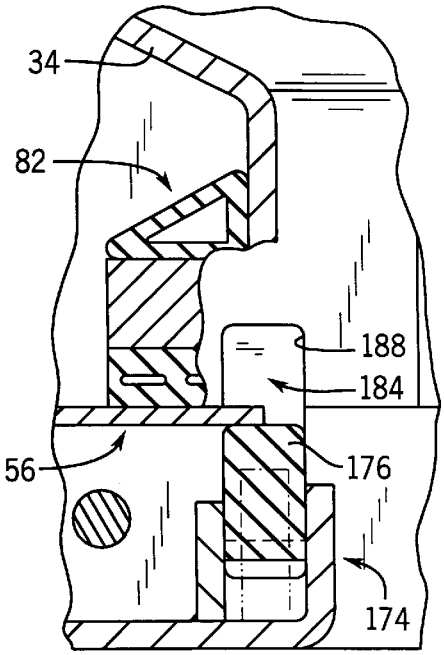
FIG. 19 is an enlarged sectional view taken along line 19—19 of FIG. 3.

Turning to FIGS. 18 and 19, the side walls of frame 34 each define a vertically elongated opening or slot 188. Notably, the opening or slot 188 has a vertical dimension greater than the maximum vertical travel of the gate 56 relative to the frame 34 of gate assembly 32. Moreover, each opening or slot 188 is disposed, in a fore-and-aft direction, on the respective side walls of the frame 34 such that when the gate 56 is in a fully opened position (FIG. 19), the distal end or edge of gate 56 is generally centralized, in a fore-and-aft direction, relative to the seals 184, 186. In the illustrated embodiment, the elongated slot or opening 188 is configured to allow the seal bar 176 of the lower seal 174 to pass endwise therethrough, thus, enhancing serviceability and access to the lower seal 174.

As shown, each edge seal 184 is snugly accommodated and held within the slot 188 defined by the frame 34 of gate assembly 32. Each edge seal 184 is preferably fabricated from an ultrahigh molecular weight polyethylene having FDA approval for food contact. Notably, the thickness of each edge seal 184 is slightly greater than the thickness of the respective side wall of the frame 34 in which it is mounted.

As shown in FIG. 18, the side or edge seal 184 is spring biased against the respective side or edge of the gate 56. In the illustrated form of the invention, a Nitrile FDA approved seal 187 is arranged in combination with a bearing plate 141' used to mount the shaft of the cam assembly for the rotatable actuator 134. Notably, the seal 187 is configured to cover and extend beyond the perimeter of the opening or slot 188 accommodating each edge seal 184. The bearing plate 141' is fastened to the respective side wall of frame 34 in a manner similar to that described above, i.e., with fasteners 145'. As will be apparent to those skilled in the art, the force used to fasten the bearing plate 141' to the side wall of the frame 34 is transferred through the seal 187 to resiliently bias the respective edge seal against a respective side of the gate 56 in a manner effectively sealing the sides of the gate 56 and the frame 34 of the gate assembly 32.

During transportation of the hopper car 10 between locations, gate 56 is maintained in a sealed and closed position as schematically illustrated in FIG. 12. To maintain the gate 56 in this sealed condition, the actuators 132, 134 of mechanism 130 are in the engaged position, schematically illustrated in FIGS. 12 and 17, thereby causing the frame 34, gate 56 and seal structure 82 to combine with each other in a manner effecting a sealed relationship therebetween. The downward force of the seal structure 82 on the actuators 132, 134 of mechanism 130 and the overcenter design of the cam assemblies 136 allows the cams 144, 146 and 148 of each cam assembly 136 to operationally act as locks to prevent the gate 56 from inadvertently moving toward an unlocked and unsealed condition during transportation of the railcar between locations. Moreover, the outer seal structure 86 is enabled with the gate 56 in a sealed and closed condition thereby inhibiting moisture, dirt, dust and other debris from passing along the top or upper surface 58 of the gate 56 into the enclosure 12 of the hopper car 10.

During transportation of the railroad car 10 between locations, the cover 160 including seal 165 are pressed against the flanged skirt on the frame 34 of the gate assembly 32 thereby inhibiting moisture and/or debris from contaminating the discharge plenum 154 of the gate assembly 32. Furthermore, the lower seal 174 closes and seals the gap or opening 172 between the frame 34 and the underside or surface 60 of the gate 56 thereby inhibiting dirt, moisture and/or debris from passing into and contaminating the discharge plenum 154 of gate assembly 32. The edge seals 184, 186 are resiliently biased against the opposed sides of the gate 56 and furthermore add to the protection offered by the present invention in inhibiting moisture, dirt and/or related debris from contaminating either the enclosure 12 of the hopper car 10 or the discharge plenum 154 on the gate assembly 32.

When the hopper car 10 is positioned at a site for unloading of the particulate matter within the enclosure 12, the gate assembly design of the present invention uniquely provides either of two different procedures to be used to effect unloading of the particulate matter from the enclosure 12. With either procedure or method of unloading the particulate matter, a supply of pressurized air is preferably and continually ingested into the enclosure 12 through the fluidizing members 26 to effect pressurization and a fluidization effect within the enclosure 12 of the hopper car 10. Advantageously, the sealing structure 82 of the gate assembly 32 of the present invention permits pressurization of the enclosure 12 of the hopper car up to about 15 psig. during unloading of the particulate matter. As will be appreciated by those skilled in the art, pressurization equal to about 15 psi. within the enclosure 12 of the hopper car 10 readily permits discharge of particulate matter using a pressure differential technique. Moreover, pressurization of the enclosure 12 of hopper car 10 up to about 15 psi. will likewise promote discharge of particulate matter through the gate assembly after the gate 56 is unsealed and moved to an open position.

When a pressure differential technique or process is utilized to discharge the particulate matter from the enclosure 12 of the hopper car 10, mechanism 130 is conditioned to maintain the gate 56 in a sealed and closed position. Valve 31 on conduit 30 is opened and a conventional vacuum system (not shown) is connected to and suction is drawn through the conduit 30 thereby effecting a pressure differential at the pneumatically enabled outlet 28. The pressure differential at the outlet 28 results in the withdrawl of particulate matter through the outlet 28 and from the enclosure 12 of the hopper car 10.

Alternatively, the discharge of particulate matter from the enclosure 12 of hopper car 10 can be effected by unsealing and opening the gate 56 of the gate assembly 32. To unseal the gate 56, mechanism 130 is conditioned to an open or unsealed condition. That is, the operating handles 150 are operated to rotate the actuators 132, 134 of mechanism 130 in a manner lowering the gate 56 relative to the frame 34 of the gate assembly 32. When the gate 56 is unsealed, the latch structure 164 is released from its operative engagement with the rotatable actuator 134. Thus, the cover 160 along with the seal 165 can be pivotally moved about the generally horizontal axis 162 to an open position. After being unlatched from the rotatable actuator 134 of mechanism 130, the free end 166 of latch structure 164 preferably combines with suitable means on the hopper car 10 for holding cover 160 in an open position.

Typically, and to limit exposure of the particulate matter to contaminants, the unloading apparatus 156 (FIG. 3) is moved under the now open bottom of the discharge plenum 154 of the gate assembly 32 and is clamped or otherwise attached to the flanged skirt configuration on the frame 34 of the gate assembly 32. As will be appreciated by those skilled in the art, in this clamped position, the inlet opening 157 (FIG. 5) to the unloading apparatus 156 is in registry with the discharge plenum 154 to receive particulate matter from the enclosure 12 without exposing the particulate matter to contaminants or moisture acting thereon.

After the unloading apparatus 156 is properly positioned and operably affixed to the frame 34 of the gate assembly 32, the drive mechanism 66 is operated to move the gate 56 to an open position. Notably, the gate 56 is lowered to an unsealed condition before it is slidably moved to an open position with the drive mechanism 66. Accordingly, and in the embodiment of the invention illustrated for exemplary purposes, the upper surface 58 of the gate 56 is removed from contact with the seal structure 82 before a horizontal movement is imparted to the gate 56, thus, reducing the likelihood of damage to the seal structure 82 resulting from horizontal movement of the gate 56.

Figure 17:
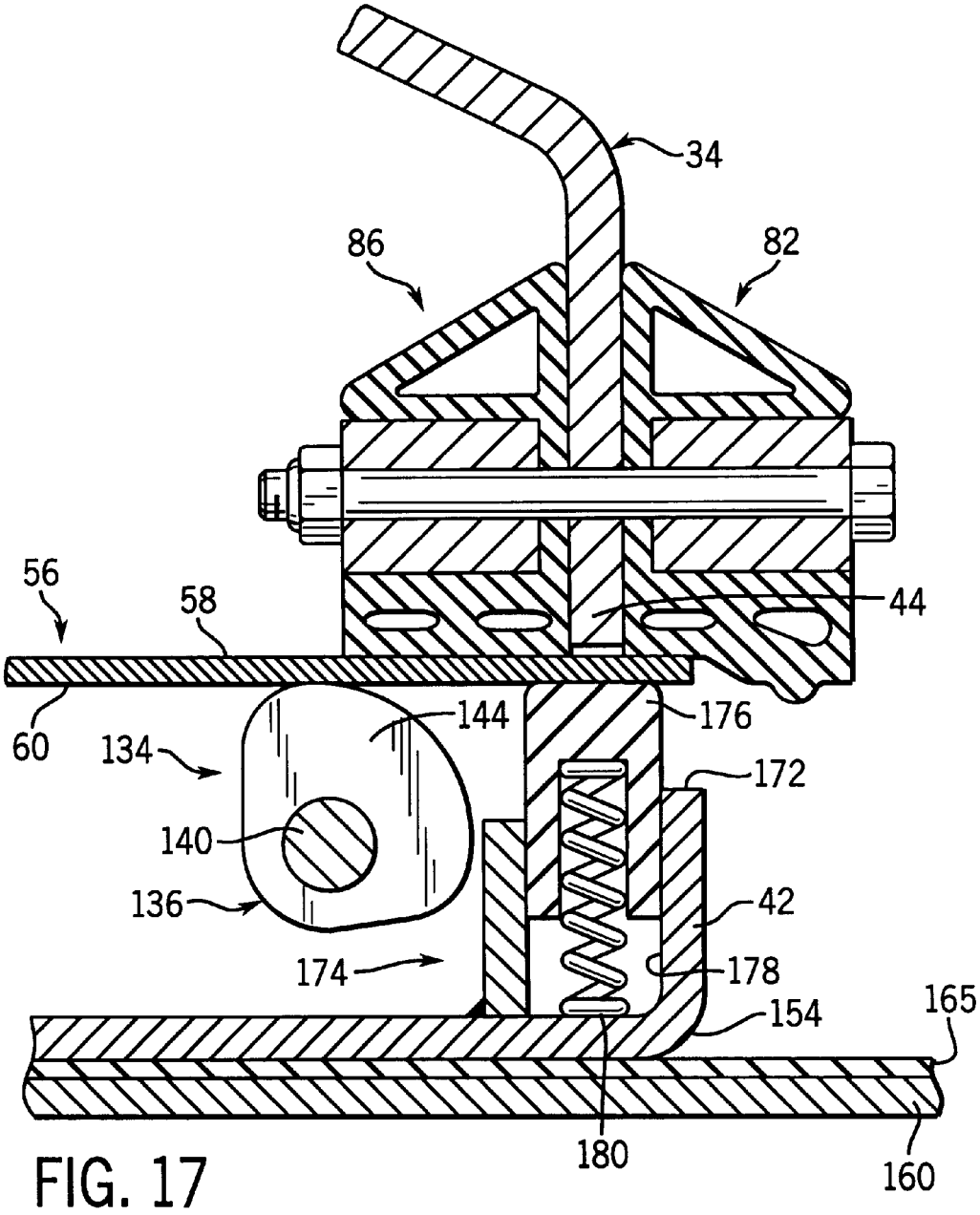
FIG. 17 is a sectional view similar to that illustrated in FIG. 16 but showing the gate of the gate assembly in an unsealed condition.

Once the gate 56 is moved to an open position, mechanism 130 is again operated, as through handles 150, to reseal the frame 34, the gate 56 and the seal structure 82 relative to each other, as schematically represented in FIG. 17. In the position schematically represented in FIG. 17, the gate 56 is pressed against the seal structure 82 to permit the air ingested into the enclosure 12 during discharge of the particulate matter to have an optimum effect on the particulate matter and thereby enhance movement of the particulate matter in the enclosure 12 toward the respective opening 16 in the bottom 14 of the hopper car 10. Once the gate 56 is moved to an open position, both handles 150 of mechanism 130 are preferably rotated to actuate both cam assemblies 136.

Of course, with the gate 56 being opened, particulate matter passes from the enclosure 12 through the discharge opening 36 and the discharge plenum 154 and into the unload apparatus 156. As will be appreciated by those skilled in the art, the ledgeless design of the discharge opening 36 in frame 34 of the gate assembly 32 facilitates movement of the particulate matter and fine particles therethrough. Moreover, the downwardly inclined or slanted surface 94 on the upper section 88 of the seal structure 82 furthermore enhances movement of particulate matter therepast.

Notably, for the entire time the gate 56 is moved or displaced between sealed and unsealed conditions relative to the seal structure 82, the lower seal 174 remains in constant sealing contact with the underside or surface 60 of the gate 56. Accordingly, the gap or opening 172 in the frame 34 of the gate assembly 32 for permitting reciprocal generally horizontal movement of the gate 56 between closed and open positions remains sealed against moisture, dirt and/or other debris passing through the opening 172 and along the underside 60 of the gate 56 to contaminate the discharge plenum 154 of gate assembly 32. In the position schematically illustrated in FIG. 17, the lower seal 174 furthermore serves to limit—if not eliminate—the amount of particulate matter and fine particles that can inadvertently escape through the opening 172 thereby enhancing the economics and surrounding ambient atmospheric conditions during the particulate matter unloading process. Additionally, the resiliently biased edge seals 184, 186 continuously press against the opposed sides of the gate 56 to further inhibit—if not eliminate—the amount of particulate matter and fine particles that can inadvertently escape along the opposed sides of the gate 56 thereby enhancing the economics and the surrounding atmospheric conditions during the particulate matter unloading process.

Following the discharge of particulate matter through the opened gate assembly 32, both actuators 132, 134 of mechanism 130 are rotated to lower the gate 56 from its sealed condition relative to the seal structure 82 and to position actuator 132 to allow the gate 56 to pass thereover when moved to its closed position. Notably, during the discharge of particulate matter through the open gate assembly 32, particulate matter passes over the cam assembly 136 of rotatable actuator 132. Thus, the rotation of the cam assembly 136 of actuator 132 prior to moving the gate 56 to its closed position will impart a self-cleaning action or effect to the cam assembly 136 associated with actuator 132. Likewise, rotation of actuator 134 will both effect lowering of the gate 56 while also imparting a self-cleaning effect on the rotatable cam assembly 136 associated with the rotatable actuator 134 in case any material residue was deposited thereon during the unloading process through the open gate assembly 32.

After gate 56 is lowered to its unsealed condition, the drive mechanism 66 is operated to return the gate 56 to its closed position. Because of the ledgeless configuration of the discharge opening 136, there are no sills or ledges to hold a residuary buildup of material fines thereon and, therefore, the upper surface 58 of the gate 56 remains relatively free of residuary material as the gate 56 is moved to a closed position. As will be appreciated, the ability to limit or eliminate material fines on the upper surface 58 of the gate 56 enhances the likelihood of maintaining a proper sealing relationship between the upper surface 58 of gate 56 and the sealing structure 82. In the preferred form of the invention, lowering of the gate 56 to the unsealed condition protects the seal structure 82 against damage which could result from horizontal movement of the gate 56 relative thereto.

After gate 56 is moved to its closed position, the cover or sanitary plate 160 is released or unlatched from its attachment to the hopper car 10 thereby allowing the plate 160 to rotate about its generally horizontal axis 162 to a position beneath the discharge chamber or plenum 154. Preferably, the latch structure 164 on the cover or sanitary plate 160 is positioned such that the hook-shaped free end 166 of the latch structure 164 overlies shaft 140 of actuator 134 of mechanism 130 as schematically represented in FIG. 15. Thereafter, the handles 150 of actuators 132, 134 are rotated such that the cam assembly 136 associated with each actuator 132, 134 of mechanism 130 causes the frame 34 of gate assembly 32, the gate 56 and the seal structure 82 to reestablish a sealed relationship relative to each other thereby sealing the gate assembly 32 closed.

As will be appreciated, rotation of actuator 134 of mechanism 130 causes the projection 170 on shaft 140 of actuator 134 to operably engage the distal end 168 of the latch structure 164 thereby causing substantially simultaneous sealing of the sanitary plate or cover 160 against the flared flange on the frame 34 and sealing of the gate assembly 32 closed. Of course, sealing the sanitary plate 160 against the flared flange on the frame 34 seals closed the discharge plenum 154 thereby protecting it against dirt, debris and/or related contaminants and moisture during transport of the car 10 between locations. At the same time, the lower seal 174 maintains a sealed relationship with the lower surface 60 of gate 56 while the resiliently biased edge seals 184, 186 inhibit moisture, dirt, dust and related debris from passing into the enclosure 12 on opposite sides of the gate 56 during transport of the car between locations.

From the foregoing, it will be observed that numerous modifications and variations can be effected without departing from the true spirit and scope of the novel concept of the present invention. Moreover, it will be appreciated that the present disclosure is intended set forth exemplifications of the invention which are not intended to limit the invention to the specific embodiments illustrated. Rather, the disclosure is intended to cover by the appended claims all such modifications as fall within the scope of the claims.

What is claimed is:

1. A gate assembly for allowing particulate matter to be discharged from an enclosure of a railroad hopper car using either a pressure differential technique or gravitationally, said hopper car defining a plurality of interconnected permeable walls funneling downwardly toward an opening and including an outlet structure adjacent the discharge opening for effecting pneumatic discharge of the matter from the enclosure of the hopper car, said gate assembly comprising:

a frame arranged in bordering relationship relative to the opening defined by said hopper car and defining a ledgeless discharge opening for permitting particulate matter to gravitationally pass therethrough, and with said frame further including wall structure depending from said ledgeless discharge opening to define a plenum chamber arranged in surrounding relation relative to said ledgeless opening and into which particulate matter can flow;

a gate supported on the frame for movement between the outlet structure on said hopper car and the plenum chamber on said frame;

a drive mechanism for moving said gate between an open position and a closed position;

flexible and compressible seal structure carried on the frame and arranged in surrounding relation relative to the ledgeless discharge opening defined by said frame;

a mechanism for vertically urging said gate into engagement with said seal structure independent of the sliding movement of the gate when said gate is in the closed position and such that the enclosure of said hopper car is configured to be pressurized to about 15 psig. thereby enhancing discharge of the particulate matter from said enclosure through said outlet structure under the influence of a pressure differential; and a cover carried on said frame and arranged in operative sealing combination with said wall structure on said frame for inhibiting contamination of said plenum chamber, and wherein said cover is alternatively movable to allow the particulate matter to pass from said gate assembly through said ledgeless discharge opening after said gate is moved to the open position.

2. The gate assembly according to claim 1 wherein said drive mechanism comprises a rack and pinion assembly.

3. A gate assembly for allowing particulate matter to be discharged from an enclosure of a railroad hopper car using either a pressure differential technique or gravitationally, said hopper car defining a plurality of interconnected permeable walls funneling downwardly toward an opening and including an outlet structure adjacent the discharge opening for effecting pneumatic discharge of the matter from the enclosure of the hopper car, said gate assembly comprising:

a frame defining a ledgeless discharge opening adapted to be arranged in bordering relationship relative to the opening defined by said hopper car and wall structure depending from said opening to define a plenum chamber arranged in surrounding relation relative to said ledgeless opening and into which particulate matter may flow;

a gate supported on the frame for movement between the outlet structure on said hopper car and the plenum chamber on said frame;

a drive mechanism for moving said gate between an open position and a closed position;

seal structure carried on the frame and arranged in surrounding relation relative to the discharge opening defined by said frame, with said seal structure including a seal mounted to an interior of the opening defined by said frame;

a mechanism for urging said gate into engagement with said seal structure when said gate is in the closed position such that the enclosure of said hopper car can be pressurized to about 15 psig. thereby permitting discharge of the particulate matter from said enclosure through said outlet structure under the influence of a pressure differential; and a cover carried on said frame and arranged in operative sealing combination with said wall structure on said frame for inhibiting contamination of said plenum chamber, and wherein said cover is alternatively movable to allow the particulate matter to pass from said gate assembly through said ledgeless discharge opening after said gate is moved to the open position.

4. The gate assembly according to claim 3 wherein said seal structure further includes a plurality of fasteners for accurately mounting said seal to the frame of the gate assembly.

5. The gate assembly according to claim 3 wherein said seal structure further includes an outer seal carried on the frame and mounted to an exterior of the discharge opening defined by the frame of the gate assembly.

6. The gate assembly according to claim 4 wherein said fasteners include elongated threaded bolts passing endwise through the seal to mount the seal structure to the frame of the gate assembly.

7. The gate assembly according to claim 6 wherein said seal structure further includes means provided on the seal for sealing a lengthwise portion of the bolt passing through the frame thereby inhibiting contamination of the particulate matter within said enclosure.

8. The gate assembly according to claim 3 wherein said seal includes upper and lower sections with a rigid material member disposed therebetween to add strength and rigidity to the seal structure.

9. The gate assembly according to claim 8 wherein the upper section of said seal has a vertically beveled surface for promoting gravitational movement of particulate matter therepast.

10. The gate assembly according to claim 8 wherein the lower section of said seal has a hollow configuration to enhance compressibility of the seal.

11. The gate assembly according to claim 8 wherein the upper and lower sections of the seal are joined to each other by a central web which, when the seal is mounted to the frame, is disposed between the rigid material member and the frame.

12. The gate assembly according to claim 5 wherein the outer seal includes a rigid metal member for adding strength and rigidity to the outer seal.

13. The gate assembly according to claim 12 wherein a lower section of the outer seal has a hollow configuration to enhance compressibility of the outer seal.

14. The gate assembly according to claim 12 wherein said cover is provided with a seal to enhance the sealing relationship between the cover and the wall structure of the frame of the gate assembly.

15. The gate assembly according to claim 1 wherein said mechanism for urging said gate into engagement with said seal structure includes cam assemblies arranged beneath the gate and which, upon rotation of an operating handle, vertically displace the gate relative to the frame.

16. The gate assembly according to claim 15 wherein each cam assembly of said mechanism for urging said gate into engagement with said seal structure is configured as an overcenter mechanism and includes an actuating member eccentrically arranged on a rotatable shaft and wherein, when the eccentric actuating member is moved overcenter, the compressive forces of the seal structure acting against the gate hold the eccentric member in position to prevent horizontal movement of the gate toward the open position.

17. The gate assembly according to claim 1 wherein said mechanism for urging said gate into engagement with said seal structure comprises horizontally spaced self-cleaning cam assemblies arranged beneath and toward opposite ends of said gate.

18. The gate assembly according to claim 17 wherein said each cam assembly includes an elongated shaft rotatable about a fixed axis and journalled along the length thereof by said frame, with two or more cams secured in spaced relation along the length of said shaft in eccentric relationship relative to said axis, and an operating handle connected to said shaft for operation external to the frame of said gate assembly.

19. The gate assembly according to claim 18 wherein each cam assembly further includes a seal arranged about said shaft for inhibiting matter from passing along and between the shaft and said frame.

20. A gate assembly for allowing particulate matter to be discharged from an enclosure of a railroad hopper car using either a pressure differential technique or gravitationally, said hopper car defining a plurality of interconnected permeable walls funneling downwardly toward an opening and including an outlet structure adjacent the discharge opening for effecting pneumatic discharge of the matter from the enclosure of the hopper car, said gate assembly comprising:

a frame defining a ledgeless discharge opening adapted to be arranged in bordering relationship relative to the opening defined by said hopper car and wall structure depending from said opening to define a plenum chamber arranged in surrounding relation relative to said ledgeless opening and into which particulate matter may flow;

a gate supported on the frame for movement between the outlet structure on said hopper car and the plenum chamber on said frame;

a drive mechanism for moving said gate between an open position and a closed position;

seal structure carried on the frame and arranged in surrounding relation relative to the discharge opening defined by said frame;

a mechanism for urging said gate into engagement with said seal structure when said gate is in the closed position and independent of the sliding movement of the gate such that the enclosure of said hopper car can be pressurized to about 15 psig. thereby permitting discharge of the particulate matter from said enclosure through said outlet structure under the influence of a pressure differential, with said mechanism for urging said gate into engagement with said seal structure including horizontally spaced rotational cam assemblies arranged beneath and toward opposite ends of said gate, with at least one cam assembly including an actuator arranged to combine with latch structure for moving a cover into operative combination with said wall structure when said cam assembly is rotated to urge said gate into engagement with said seal structure; and with said cover being carried on said frame and arranged in operative sealing combination with said wall structure on said frame for inhibiting contamination of said plenum chamber, and wherein said cover is alternately movable to allow the particulate matter to pass from said gate assembly through said ledgeless discharge opening after said gate is moved to the open position.

21. The gate assembly according to claim 1 wherein said cover is carried on said frame for movement about a generally horizontal axis extending generally parallel with said gate.

22. A discharge gate assembly for a railroad hopper car defining an enclosure for holding particulate matter, said hopper car defining an opening and an outlet arranged adjacent said discharge opening, said gate assembly comprising:

a rigid frame arranged in cooperative relationship with the opening on the hopper car when the gate assembly is mounted to the hopper car and defining a ledgeless discharge opening for permitting particulate matter in said enclosure to pass therethrough, and wherein said frame further includes wall structure depending from said ledgeless opening to define a plenum chamber arranged in surrounding relation relative to said ledgeless opening and into which particulate matter can flow;

flexible and compressible seal structure for sealing about the discharge opening defined by said frame;

a gate movably carried on said frame, and wherein, in one position, said gate, said seal structure and the frame of the gate assembly operate in vertical combination with each other independent of the sliding movement of the gate to allow an increased gage pressure of about 15 psig. to be established in the enclosure of said hopper car thereby promoting discharge of the particulate matter from the enclosure through the outlet defined by the hopper car under the influence of a pressure differential, and wherein said gate is alternatively movable to a second position independent of the sliding movement of the gate to allow the particulate matter to be discharged through the ledgeless opening defined on the frame of the gate assembly; and a movable cover carried on said frame and arranged in operative sealing combination with said wall structure on said frame for inhibiting contamination of said plenum chamber.

23. A discharge gate assembly for a railroad hopper car defining an enclosure for holding particulate matter, said hopper car defining an opening and an outlet arranged adjacent said discharge opening, said gate assembly comprising:

a rigid frame defining a ledgeless discharge opening arranged in cooperative relationship with the opening on the hopper car when the gate assembly is mounted to the hopper car;

seal structure for sealing about the discharge opening defined by said frame, with said seal structure including an inner seal arranged to an interior of the ledgeless opening defined by said frame; and a gate movably carried on said frame, and wherein, in one position, said gate, said seal structure and the frame of the gate assembly operate in combination with each other to allow an increased gage pressure of about 15 psig. to be established in the enclosure of said hopper car thereby promoting discharge of the particulate matter from the enclosure through the outlet defined by the hopper car under the influence of a pressure differential, and wherein said gate is alternatively movable to a second position to allow the particulate matter to be discharged through the ledgeless opening defined on the frame of the gate assembly.

24. The gate assembly according to claim 23 wherein said seal includes a resilient elastomeric member and a rigid metal mount for securing the elastomeric member to the frame of the gate assembly.

25. The gate assembly according to claim 23 wherein an upper surface of said seal is downwardly slanted to promote gravitational movement of particulate matter therepast.

26. The gate assembly according to claim 23 wherein said seal structure further includes an outer seal including a resilient elastomeric member and a rigid metal mount for securing the elastomeric member of said outer seal to the frame of the gate assembly.

27. The gate assembly according to claim 22 further including an actuating mechanism disposed beneath said gate for causing the frame, the gate and the seal structure to be positioned relative to each other thereby establishing a sealing relationship about the discharge opening when said mechanism is in a first condition and for disabling said sealing relationship when said mechanism is in a second condition.

28. The gate assembly according to claim 27 wherein said actuating mechanism includes a plurality of actuators mounted on the frame of the gate assembly.

29. The gate assembly according to claim 27 wherein said actuating mechanism includes at least two horizontally spaced cam assemblies rotatably supported on the frame of the gate assembly.

30. The gate assembly according to claim 29 wherein each cam assembly is rotatable between a position engaging an underside of the gate whereby pressing said gate against the seal structure with sufficient force to allow the increased pressure to be established in the enclosure of the hopper car and a position disengaging said gate from pressing against said seal structure thereby allowing said gate to be moved to the second position.

31. The gate assembly according to claim 29 wherein each cam assembly includes a shaft journalled by the frame of the gate assembly for rotation about a fixed axis, with two or more cams arranged along the length of the shaft in eccentric relationship relative to the fixed axis and which rotate with the shaft, and an operating handle secured to the shaft and disposed to promote access thereto from the exterior of the frame of the gate assembly.

32. The gate assembly according to claim 31 wherein each cam assembly includes seals arranged about that portion of the shaft passing through the frame of the gate assembly for inhibiting debris and matter from passing along and about the shaft and the frame.

33. The gate assembly according to claim 22 further including edge seals carried by the frame for biased engagement with opposed sides of said gate.

34. A gate assembly for a railroad hopper car defining an enclosure for holding particulate matter, said gate assembly comprising:

a frame defining a discharge opening and including flanged structure depending from and arranged in surrounding relation relative to said discharge opening to define a plenum chamber;

an elongated gate supported for movement on said frame above said plenum chamber;

a drive mechanism for moving said gate between open and closed positions relative to the discharge opening defined by said frame;

seal structure carried on said frame and arranged in surrounding relation relative to said discharge opening;

a cover carried by said frame for movement between open and closed positions, wherein, when in said closed position, the cover operatively combines with said flanged structure on said frame to seal closed said plenum chamber and, when in said open position, said cover is removed from and permits particulate matter to pass through the plenum chamber after said gate is moved to an open position; and a mechanism for sealing closed said discharge opening defined by said frame by positioning said gate and said sealing structure in sealing relationship relative to the frame of the gate assembly while generally simultaneously moving said cover into sealing closed relation relative to said flanged structure thereby inhibiting debris from contaminating said plenum chamber.

35. The gate assembly according to claim 34 wherein said frame includes extensions extending generally parallel relative to each other for supporting a lengthwsie section of the elongated gate.

36. The gate assembly according to claim 34 wherein the drive mechanism for moving said gate includes an operating shaft mounted on said frame of the gate assembly for rotation about a fixed axis.

37. The gate assembly according to claim 36 wherein said operating shaft includes an elongated shaft rotatably mounted on the frame of the gate assembly with operating handles at opposite ends thereof, at least one pinion mounted on the shaft for rotation therewith, and a rack secured to an underside of said gate and engagable with the pinion such that upon rotation of said elongated shaft said gate is horizontally moved relative to said frame.

38. The gate assembly according to claim 34 wherein said discharge opening has a ledgeless configuration to enhance discharge of the particulate matter from the enclosure of the hopper car.

39. The gate assembly according to claim 34 wherein said seal structure comprises a seal mounted to an interior of the discharge opening defined by said frame.

40. The gate assembly according to claim 39 wherein a series of elongated fasteners secure the seal to the frame of the gate assembly by passing endwise through the seal structure.

41. The gate assembly according to claim 40 wherein said seal structure further includes means on the seal for sealing a lengthwise portion of the fastener passing endwise therethrough.

42. The gate assembly according to claim 39 wherein said seal includes upper and lower sections with a rigid material member disposed therebetween for adding strength and rigidity to the seal structure.

43. The gate assembly according to claim 42 wherein the upper section of the inner seal is configured with a downwardly slanting surface to promote movement of the particulate matter therepast.

44. The gate assembly according to claim 42 wherein the lower section of the inner seal is configured to promote compressibility thereof to enhance the sealing engagement with an upper surface of the gate.

45. The gate assembly according to claim 42 wherein the lower section of the outer seal is configured to promote compressibility thereof to enhance the sealing engagement with an upper surface of the gate.

46. The gate assembly according to claim 34 wherein said cover is carried by said frame for pivotal movement about a generally horizontal axis extending generally parallel with the gate.

47. The gate assembly according to claim 34 further including a latch for holding said cover in said open position removed from said plenum chamber.

48. The gate assembly according to claim 34 wherein said mechanism for sealing closed said discharge opening includes a plurality of rotatable actuators disposed beneath said gate for vertically elevating said gate such that an upper surface of said gate is pressed into engagement with said seal structure thereby establishing a sealing relationship about the discharge opening when said mechanism is in a first condition and for allowing the gate to vertically lower from engagement with said seal structure and be moved to the open position when said mechanism is in a second condition.

49. The gate assembly according to claim 48 wherein said actuators are disposed toward opposite ends of said gate and extend in a direction generally normal to a direction in which said gate moves between the open and closed positions.

50. The gate assembly according to claim 49 wherein said actuators are configured to be self-cleaning upon rotation thereof.

51. The gate assembly according to claim 48 wherein said mechanism for said latch is operable in combination with at least one of said rotatable actuators of said mechanism for sealing closed said gate for moving said cover into sealing relationship relative to the flanged structure on the frame of the gate assembly substantially simultaneously with sealing closed said discharge opening in the frame of the gate assembly.

52. The gate assembly according to claim 34 wherein said mechanism for sealing closed said discharge opening includes at least two horizontally spaced cam assemblies rotatably supported on the frame of the gate assembly.

53. The gate assembly according to claim 52 wherein each cam assembly is rotatable between a first position engaging an underside of the gate thereby pressing said gate against the seal structure with sufficient force to establish a sealed relationship between an upper surface of the gate, the seal structure and the frame of the gate assembly and a second position disengaging said gate from pressing against said seal structure thereby allowing said gate to be moved to the open position.

54. The gate assembly according to claim 53 wherein each cam assembly of said mechanism for sealing closed said gate is self-cleaning upon rotation thereof.

55. The gate assembly according to claim 53 wherein a latch is operable in combination with one of said cam assemblies for moving said cover into sealing relationship relative to the flanged structure on the frame of the gate assembly substantially simultaneously with sealing closed said discharge opening in the frame of the gate assembly.

56. The gate assembly according to claim 52 wherein each cam assembly includes a shaft supported on the frame of the gate assembly for rotation about a fixed axis, with two cams arranged along the length of the shaft in eccentric relationship relative to the fixed axis and which rotate with the shaft, and an operating handle secured to the shaft and disposed to promote access thereto.

57. The gate assembly according to claim 52 wherein each cam assembly includes seals disposed along that portion of the shaft supported by said frame of the gate assembly for sealing said cam assembly to the frame of the gate assembly.

58. The gate assembly according to claim 34 further including structure carried by the frame for sealing between opposed sides of the gate and the frame of the gate assembly.

59. The gate assembly according to claim 34 further including a seal extending across and biased against an underside of the gate.

60. A gate assembly for a railroad hopper car having an enclosure for holding particulate matter, said gate assembly comprising:

a frame defining a generally rectangularly shaped ledgeless discharge opening;

resilient seal structure carried on the frame about an entire periphery of said rectangularly shaped discharge opening;

a generally rectangularly shaped gate mounted on said frame for movement between open and closed positions;

a rotational mechanism for establishing a sealing relationship between the gate, said seal structure and said frame and about the entire periphery of said rectangularly shaped discharge opening independent of the sliding movement of the gate and through vertical displacement of at least one of said gate, said seal structure and said frame and as long as said gate is in said closed position to allow pressurization of said enclosure to about 15 psig. thereby enhancing the discharge of particulate matter from said enclosure of said hopper car pneumatically; and a drive mechanism for selectively moving said gate to the open position such that the particulate matter can be alternatively unloaded from said enclosure of the hopper car gravitationally.

61. A gate assembly for a railroad hopper car having an enclosure for holding particulate matter, said gate assembly comprising:

a frame defining a ledgeless discharge opening;

seal structure mounted to an interior periphery of the ledgeless opening defined by the frame of the gate assembly;

a gate mounted on said frame for movement between open and closed positions; and a mechanism for establishing a sealing relationship between the gate, said seal structure and said frame when said gate is in said closed position such that the particulate matter can be unloaded from said enclosure of said hopper car pneumatically; and a drive mechanism for selectively moving said gate to the open position such that the particulate matter can be unloaded from said enclosure of the hopper car gravitationally.

62. The gate assembly according to claim 61 wherein said seal structure includes upper and lower sections with a rigid material member arranged in combination therewith for adding strength and rigidity to the seal structure.

63. The gate assembly according to claim 62 wherein the upper section of the seal structure is configured with a downwardly slanting surface to promote movement of the particulate matter therepast.

64. The gate assembly according to claim 62 wherein the lower section of the seal structure is configured to promote compressibility thereof to enhance the sealing engagement with an upper surface of the gate.

65. The gate assembly according to claim 60 wherein said seal structure further includes an outer seal arranged on the frame of the gate assembly to the exterior of the discharge opening.

66. The gate assembly according to claim 60 wherein said mechanism for establishing a sealing relationship between the gate, said seal structure and the frame includes a plurality of rotatable actuators disposed beneath said gate for vertically elevating said gate such that an upper surface of said gate is pressed into engagement with said seal structure thereby establishing a seal capable of holding a gage pressure of about 15 psig. in the enclosure of said hopper car when said mechanism is in a first condition and for allowing the gate to vertically lower from engagement with said seal structure and be moved to the open position when said mechanism is in a second condition.

67. The gate assembly according to claim 66 wherein said actuators are disposed toward opposite ends of said gate and extend in a direction generally normal to a direction in which said gate moves between the open and closed positions.

68. The gate assembly according to claim 66 wherein said actuators are configured to be self-cleaning upon rotation thereof.

69. The gate assembly according to claim 60 wherein said mechanism for sealing closed said discharge opening includes at least two horizontally spaced cam assemblies rotatably supported on the frame of the gate assembly.

70. The gate assembly according to claim 69 wherein each cam assembly is rotatable between a first position engaging an underside of the gate thereby pressing said gate against the seal structure with sufficient force to establish a sealed relationship between an upper surface of the gate, the seal structure and the frame of the gate assembly which is capable of holding a gage pressure of about 15 psig. within the enclosure of said hopper car and a second position disengaging said gate from pressing against said seal structure thereby permitting said gate to be moved to the open position.

71. The gate assembly according to claim 69 wherein each cam assembly is self-cleaning upon rotation thereof.

72. The gate assembly according to claim 69 wherein each cam assembly includes a shaft supported on the frame of the gate assembly for rotation about a fixed axis, with two cams arranged along the length of the shaft in eccentric relationship relative to the fixed axis and which rotate with the shaft, and an operating handle secured to the shaft and disposed to promote access thereto.

73. The gate assembly according to claim 72 wherein each cam assembly includes seals disposed along that portion of the shaft supported by said frame of the gate assembly for sealing said cam assembly to the frame of the gate assembly.

74. The gate assembly according to claim 60 further including structure carried by the frame for sealing between lateral sides of the gate and the frame of the gate assembly.

75. The gate assembly according to claim 60 further including a seal extending across and biased against an underside of the gate.

76. The gate assembly according to claim 60 wherein the drive mechanism for selectively moving said gate includes a rack and pinion assembly arranged beneath the gate.

77. A gate assembly for a railroad hopper car capable of holding particulate matter within an enclosure, said gate assembly comprising:

a rigid frame defining a discharge opening through which the particulate matter is discharged from said hopper car;

seal structure arranged in surrounding relation relative to said discharge opening;

a gate mounted on said frame for movement relative to said discharge opening;

a mechanism for positioning said gate and seal structure relative to said frame to establish a seal about said discharge opening;

a drive mechanism for sliding said gate relative to said frame between open and closed positions; and a seal extending across and biased against an underside of said gate regardless of the vertical disposition of said gate.

78. The gate assembly according to claim 77 wherein said gate has an elongated generally planar configuration, with a first lengthwise portion of said gate extending generally horizontally across and closing the discharge opening when said gate is in a closed position and a second lengthwise portion extending beyond said the discharge opening defined by said frame, and wherein the second lengthwise portion of said gate is supported by a pair of spaced parallel extensions extending from said frame.

79. The gate assembly according to claim 78 wherein said drive mechanism includes a rack secured to the underside of the second lengthwise portion of the gate, an elongated shaft supported on said frame for rotation about a fixed axis, a pinion carried by and rotatable with said shaft and engagable with said rack such that upon rotation of said shaft said gate moves in a generally horizontal direction.

80. The gate assembly according to claim 77 wherein said seal structure is mounted to an interior of the discharge opening defined by the frame of the gate assembly.

81. The gate assembly according to claim 77 wherein said seal structure includes an elastomeric member with a rigid material member arranged in combination therewith for adding strength and rigidity thereto.

82. The gate assembly according to claim 81 wherein said seal structure is configured with a downwardly slanting upper surface to promote movement of the particulate matter therepast.

83. The gate assembly according to claim 81 wherein said seal structure is configured to promote compressibility thereof to enhance the sealing engagement with an upper surface of the gate.

84. The gate assembly according to claim 77 wherein said mechanism for positioning said gate includes rotatable actuators disposed beneath said gate for movement between engages and disengaged positions, with said actuators being disposed toward opposite ends of said gate and extend laterally thereacross.

85. The gate assembly according to claim 84 wherein each of said actuators produce a self-cleaning action upon rotation of the actuator from said disengaged to said engaged positions.

86. The gate assembly according to claim 84 wherein each actuator of said positioning mechanism is configured as an overcenter mechanism whereby each actuator operatively locks said gate against movement toward the open position after said gate and sealing structure are positioned in sealed relationship relative to said frame.

87. The gate assembly according to claim 77 wherein said mechanism for positioning said gate includes at least two horizontally spaced cam assemblies rotatably supported on the frame of the gate assembly.

88. The gate assembly according to claim 77 wherein said seal extending across the underside of said gate includes an elongated seal bar urged into continuous engagement with the first lengthwise portion of the underside of the gate.

89. The gate assembly according to claim 88 wherein said frame defines a channel for accommodating vertical shifting movements of said seal bar relative to the frame of the gate assembly.

90. The gate assembly according to claim 89 wherein springs are accommodated within said channel for resiliently urging said seal bar against the underside of said gate.

91. The gate assembly according to claim 88 wherein said seal bar extends laterally across the width of said gate.

92. The gate assembly according to claim 88 wherein said seal bar is comprised of ultra-high molecular weight polyethylene.

93. A gate assembly for a railroad hopper car capable of holding particulate matter within an enclosure, said gate assembly comprising:

a frame defining a substantially rectangular discharge opening through which the particulate matter is discharged from said hopper car, said frame including a skirt having multiple interconnected sidewalls arranged in surrounding relation relative to said discharge opening, said skirt being configured to permit an unloading sled to be operatively arranged in combination therewith and to define a substantially vertical discharge plenum between the discharge opening in said frame and an inlet opening to said unloading sled;

upper seal structure arranged in surrounding relation relative to the discharge opening defined by said frame;

a gate mounted on the frame for sliding movement between open and closed positions and along a path extending between said upper seal structure and said discharge plenum;

a drive mechanism for moving said gate between the open and the closed positions; and lower seal structure for resiliently and continuously engaging an underside of said gate.

94. The gate assembly according to claim 93 wherein said gate has an elongated generally planar configuration, with a first lengthwise portion of said gate extending generally horizontally across and closing the discharge opening when said gate is in a closed position and a second lengthwise portion extending beyond said the discharge opening defined by said frame, and wherein the second lengthwise portion of said gate is supported by a pair of spaced parallel extensions extending from said frame.

95. The gate assembly according to claim 93 wherein said drive mechanism includes a rack secured to the underside of the second lengthwise portion of the gate, an elongated shaft supported on said frame for rotation about a fixed axis, a pinion carried by and rotatable with said shaft and engagable with said rack such that upon rotation of said shaft said gate moves in a generally horizontal direction.

96. The gate assembly according to claim 93 wherein said upper seal structure is mounted to an interior of the discharge opening defined by the frame of the gate assembly.

97. The gate assembly according to claim 95 wherein said upper seal structure includes an elastomeric member with a rigid material member arranged in combination therewith for adding strength and rigidity to the seal structure.

98. The gate assembly according to claim 96 wherein said upper seal structure is configured with a downwardly slanting upper surface to promote movement of the particulate matter therepast.

99. The gate assembly according to claim 96 wherein the elastomeric member of said upper seal structure is configured to promote compressibility thereof to enhance the sealing engagement with an upper surface of the gate.

100. The gate assembly according to claim 93 wherein said lower seal includes an elongated seal bar urged into continuous engagement with the underside of the first lengthwise portion of the gate.

101. The gate assembly according to claim 100 wherein said frame defines a channel for accommodating vertical shifting movements of said seal bar relative to the frame of the gate assembly.

102. The gate assembly according to claim 101 wherein springs are accommodated within said channel for resiliently urging said seal bar against the underside of said gate.

103. The gate assembly according to claim 100 wherein said seal bar extends laterally across the width of said gate.

104. The gate assembly according to claim 100 wherein said seal bar is comprised of ultra-high molecular weight polyethylene.

105. A gate assembly for a railroad hopper car capable of holding particulate matter within an enclosure, said gate assembly comprising:

a frame defining a generally rectangularly shaped discharge opening through which the particulate matter is discharged from said hopper car, said frame including a skirt arranged in surrounding relation relative to said discharge opening and defining a discharge plenum;

a gate mounted on the frame for sliding fore-and-aft movement between open and closed positions;

a drive mechanism engagable with an underside on said gate;

a cover movably disposed relative to the skirt on said frame for inhibiting debris from entering said discharge plenum as long as said cover is in a first position; and a seal extending laterally across in a generally perpendicular relationship relative to the fore-and-aft movement of said gate, said seal being biased into sealing relationship with the underside of said gate and permits said gate to be moved between positions while inhibiting contamination of said discharge plenum.

106. The gate assembly according to claim 105 wherein said gate has an elongated generally planar configuration, with a first lengthwise portion of said gate extending generally horizontally across and closing the discharge opening when said gate is in a closed position and a second lengthwise portion extending beyond said discharge opening defined by said frame, and wherein the second lengthwise portion of said gate is supported by a pair of spaced parallel extensions extending from said frame.

107. The gate assembly according to claim 105 wherein said drive mechanism includes a rack and pinion assembly including an elongated operating shaft assembly rotatably supported by the frame of the gate assembly.

108. The gate assembly according to claim 105 wherein said cover is mounted to the frame of the gate assembly for movement about a generally horizontal axis extending generally parallel with the gate.

109. A gate assembly for a railroad hopper car capable of holding particulate matter within an enclosure, said gate assembly comprising:

a frame defining a discharge opening through which the particulate matter is discharged from said hopper car, said frame including a skirt arranged in surrounding relation relative to said discharge opening and defining a discharge plenum;

a gate mounted on the frame for sliding movement between open and closed positions;

a drive mechanism engagable with an underside on said gate;

a cover movably disposed relative to the skirt on said frame for inhibiting debris from entering said discharge plenum as long as said cover is in a first position; and a seal extending across and biased against the underside of said gate for permitting said gate to be moved between positions while inhibiting contamination of said discharge plenum, with said seal including an elongated seal bar urged into continuous engagement with the underside of the gate.

110. The gate assembly according to claim 109 wherein said frame defines a channel for accommodating vertical shifting movements of said seal bar relative to the frame of the gate assembly.

111. The gate assembly according to claim 110 wherein springs are accommodated within said channel for resiliently urging said seal bar against the underside of said gate.

112. The gate assembly according to claim 111 wherein said seal bar extends laterally across the width of said gate.

113. The gate assembly according to claim 105 wherein said seal is comprised of ultra-high molecular weight polyethylene.

114. A gate assembly for a railroad hopper car capable of holding particulate matter within an enclosure, said gate assembly comprising:

a frame defining a discharge opening through which the particulate matter is discharged from said hopper car, said frame including a flanged skirt arranged in surrounding relation relative to said discharge opening, said skirt being configured to permit an unloading sled to be operatively arranged in combination therewith and to define a substantially vertical discharge plenum between the discharge opening in said frame and an inlet opening to said unloading sled;

seal structure arranged in surrounding relation relative to the discharge opening defined by said frame;

a gate mounted on the frame for sliding movement between open and closed positions and along a path extending between said seal structure and said discharge plenum;

a drive mechanism for moving said gate between the open and the closed positions; and edge seals biased against opposed side edges of said gate for inhibiting particulate matter from escaping from said discharge plenum after the gate is moved to the open position.

115. The gate assembly according to claim 114 wherein said edge seals are elongated in a generally vertical direction to permit and accommodate vertical shifting movements of the gate while maintaining a sealed relationship between the opposed sides on the gate and the frame.

116. The gate assembly according to claim 114 wherein said edge seals are mounted on frame of the gate assembly such that they are resiliently biased inwardly toward the opposed sides of the gate.

117. The gate assembly according to claim 114 wherein said edge seals are fabricated from ultra-high molecular weight polyethylene.

* * * * *